US009327160B2

(12) United States Patent
Tauriainen

(10) Patent No.: US 9,327,160 B2
(45) Date of Patent: May 3, 2016

(54) MODULAR SELF-SPOTTING SAFETY DEVICE FOR WEIGHTLIFTING

(76) Inventor: Jake Samuel Tauriainen, Burnaby (CA)

( * ) Notice: Subject to any disclaimer, the term of this patent is extended or adjusted under 35 U.S.C. 154(b) by 979 days.

(21) Appl. No.: 13/053,217

(22) Filed: Mar. 22, 2011

(65) Prior Publication Data

US 2012/0244999 A1 Sep. 27, 2012

(51) Int. Cl.
*A63B 21/078* (2006.01)
*A63B 71/06* (2006.01)

(52) U.S. Cl.
CPC ..... *A63B 21/078* (2013.01); *A63B 21/0783* (2015.10); *A63B 2071/0683* (2013.01)

(58) Field of Classification Search
CPC ..... A63B 21/06; A63B 21/078; A63B 2021/1609–2021/169; A63B 21/0783; A63B 2071/0683
USPC ..... 482/93, 94, 98, 104
See application file for complete search history.

(56) References Cited

U.S. PATENT DOCUMENTS

| | | | | | |
|---|---|---|---|---|---|
| 4,253,662 | A | * | 3/1981 | Podolak | 482/104 |
| 4,324,398 | A | * | 4/1982 | Hole | 482/104 |
| 4,949,959 | A | * | 8/1990 | Stevens | 482/104 |
| 4,998,721 | A | | 3/1991 | Anders et al. | |
| 5,048,826 | A | * | 9/1991 | Ryan | 482/7 |
| 5,108,354 | A | * | 4/1992 | Becker | 482/104 |
| 5,314,394 | A | * | 5/1994 | Ronan | 482/104 |
| 5,407,403 | A | * | 4/1995 | Coleman | 482/6 |
| 5,468,203 | A | * | 11/1995 | Okonkwo | 482/104 |
| 5,794,877 | A | * | 8/1998 | Ono et al. | 242/379.1 |
| 5,823,921 | A | * | 10/1998 | Dawson | 482/104 |
| 5,989,164 | A | * | 11/1999 | Kullman et al. | 482/93 |
| 5,989,166 | A | * | 11/1999 | Capizzo et al. | 482/104 |
| 6,086,520 | A | * | 7/2000 | Rodriquez | 482/104 |
| 6,296,648 | B1 | | 10/2001 | Boche et al. | |
| 6,379,287 | B1 | | 4/2002 | Slawinski et al. | |
| 6,623,409 | B1 | * | 9/2003 | Abelbeck | 482/104 |
| 6,893,381 | B2 | | 5/2005 | Slawinski | |
| 6,926,649 | B2 | * | 8/2005 | Slawinski | 482/104 |
| 7,163,488 | B2 | * | 1/2007 | Anders et al. | 482/4 |
| 7,488,277 | B1 | * | 2/2009 | Knapp | 482/104 |
| 8,444,537 | B1 | * | 5/2013 | Santoro | 482/104 |
| 8,500,608 | B1 | * | 8/2013 | Bonomi | 482/101 |
| 2002/0077224 | A1 | * | 6/2002 | Slawinski et al. | 482/93 |
| 2004/0092369 | A1 | * | 5/2004 | Slawinski et al. | 482/104 |

(Continued)

OTHER PUBLICATIONS

Nautilus, "F3 Smith Machine-II" Parts Diagram and Assembly Instructions Manual, Aug. 29, 2008, 6 pages.

(Continued)

*Primary Examiner* — Oren Ginsberg
*Assistant Examiner* — Sundhara Ganesan
(74) *Attorney, Agent, or Firm* — Michael R. Schacht; Schacht Law Office, Inc.

(57) ABSTRACT

An embodiment of a barbell and dumbbell safety spotting apparatus is a weight support cable (34*a*) wrapped around a rotating drum (44*a*) with the drum is mounted vertically above a weight lifter. The cables are connectable to a barbell assembly (24) or dumbbell assembly to provide reciprocating vertical movement of the weight assembly in a free-weight fashion. The drum has a ratcheting mechanism (55) that normally prevents downward movement of the weight assembly. The ratchet is connected to a user-operated control mechanism (28) so that the user can disengage the ratchet, allowing the weight assembly to be freely lowered. Other embodiments are described and shown.

23 Claims, 18 Drawing Sheets

(56) References Cited

U.S. PATENT DOCUMENTS

| | | | | |
|---|---|---|---|---|
| 2005/0277524 | A1* | 12/2005 | Bae | 482/93 |
| 2006/0148624 | A1* | 7/2006 | Bae | 482/93 |
| 2006/0252609 | A1* | 11/2006 | Abelbeck | 482/92 |
| 2007/0072750 | A1* | 3/2007 | Andrews | 482/104 |
| 2008/0139368 | A1* | 6/2008 | Carbone | 482/104 |
| 2009/0203505 | A1* | 8/2009 | Kroll et al. | 482/104 |
| 2009/0312162 | A1* | 12/2009 | Maiaro et al. | 482/104 |
| 2011/0230316 | A1* | 9/2011 | Johnson, III | 482/104 |
| 2011/0263395 | A1* | 10/2011 | Breaux | 482/94 |
| 2012/0058859 | A1* | 3/2012 | Elsom-Cook et al. | 482/4 |

OTHER PUBLICATIONS

Tuffstuff Fitness Equipment, Inc., "RPR-265 Power Rack (Cage)," Assembly Instructions Manual, Nov. 15, 2007, 8 pages.

* cited by examiner

MODULAR SELF-SPOTTING SAFETY DEVICE FOR WEIGHTLIFTING

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

The present device relates to the field of exercise equipment, particularly to an apparatus or device that allows a person who is exercising with dumbbells or a barbell to self-spot him or herself for increased safety and a more effective workout.

2. Prior Art

Athletes of many disciplines, as well as laypeople, improve their strength and endurance by including weight training in their workout regimens. Most people skilled in kinesiology are of the opinion that the lifter will experience superior results when using free weights rather than a cable machine. Free weights provide the lifter with a more natural workout that strengthens all the muscle groups that are used in everyday life. Specifically, free weights strengthen stabilizer muscles in a way than cable machines cannot.

For maximum strength and muscle mass gain, the lifter will perform repetitions until he or she is physically unable to raise the weight again. This is called going to exhaustion. Some exercises, such as a bicep curl, do not result in the barbell or dumbbell substantially being placed above the lifter's body. Therefore, there is no real danger of the lifter dropping the weight on him or herself and a spotter is not needed. In other exercises—such as squats, shoulder presses, and bench presses—the weight is above the lifter's body for the duration of the exercise. There is a high likelihood of the weight falling on the lifter if he or she attempts to go to exhaustion without a spotter present. In the case of elite athletes, the weight being lifted is often heavy enough to seriously injure or even kill the lifter if it is dropped. This is a reason why many people who do not have a workout partner decide to use cable machines instead of cheaper and more effective free weights. Even when a human spotter is present, accidents have occurred where the spotter fails to catch the weight when the lifter drops it.

To address this issue, the exercise industry has developed many solutions. The most widely available mechanical spotting devices are the power rack and the smith machine. A power rack is simply a large rack that the lifter is inside while lifting. A power rack cannot be used with dumbbells. The barbell sticks out the side of the rack and there are adjustable horizontal supports to prevent the bar from falling on the lifter. This is effective from a safety standpoint but leaves a lot to be desired in terms of user-friendliness. In the case of bench pressing, the supports are set to a level that allows the bar to nearly contact the lifter's chest. (In order to gain the most benefit from the workout, the lifter must move through his entire range of motion.) If the lifter reaches the point of complete exhaustion on a set, the barbell will come crashing down to within inches of his or her face. Since this would occur at the end of every set, many people would prefer a better solution.

A smith machine is not quite a free weight experience but is still better from a muscle building perspective than a cable machine. A commercial disadvantage of a smith machine is its high price, due to its size and complexity. It consists of a special barbell mounted in a nearly vertical slide mechanism with hooks attached to the barbell at the same width as the slides. When the lifter begins a set, he lifts and rotates the barbell so that the hooks detach from holes near the slides and the barbell is permitted to slide up and down. At the end of the set, the lifter simply rotates the bar to place the hooks back in their respective holes or notches, holding the barbell in place. The operational disadvantage of this approach is that many stabilizer muscles are not sufficiently stressed, leading to imbalanced muscle growth. A lifter who used only a smith machine in his training will not be able to lift the same weight if he goes to free weights later on. During free weight squats the barbell naturally follows a slightly curved path. The smith machine does not allow for this, resulting in an unnatural workout. Most smith machines are too short to allow for standing shoulder or military presses. The lifter must be seated during these exercises, reducing the benefit of the workout to his core muscles. Due to these disadvantages, many people and companies have attempted to create improved self-spotting devices.

There is a device (U.S. Pat. No. 6,296,648) that works by allowing the lifter to control the height of two horizontal supports while he or she is in the middle of his set. The motors that operate the supports are sufficiently powerful enough to lift the entire weight of the barbell. The advantage to this approach is that the lifter can perform forced reps as well as lift the bar off his or her chest if it turns out that he or she is unable to lift the bar at all after lowering it. Also, this system has nothing attached to the barbell, providing a genuine free weight workout. The disadvantages are that it can only be used for bench pressing with a barbell and is very expensive due to the large electric motors. Also, it requires household AC voltage to operate.

There are various devices that use motor-driven drums mounted in a frame that operate cables, which are attached to a barbell or dumbbells. In some of these, the motor must be activated in order for the cable to extend or retract. This requires tension and speed sensors as well as a logic processor. Examples of such devices are described in U.S. Pat. Nos. 4,949,959 and 5,048,826. In these devices the cables are not independently extendable or retractable, which reduces user-friendliness.

To provide independent travel of the cables, the weightlifting industry developed devices which have a separate motor for each cable. For example, each cable extends and retracts from a drum that is turned by a motor, as shown in U.S. Pat. No. 4,998,721. Although each motor can operate independently, they are under constant low-level actuation to maintain tension on the cables; this once again requires the use of electronic sensors. As with the patents in the previous paragraph, the fixed location of the cables prevents the apparatus from being used for dumbbells or varying lengths of barbells.

In an effort to eliminate the necessity of maintaining an actuated motor during a workout, the weightlifting industry has enlisted the use of motor-clutch assemblies. For example, as shown in U.S. Pat. No. 6,379,287, one end of each cable is attached to an assembly that moves up and down in the frame of the apparatus. This reciprocating component is fixed to an endless chain that turns a rotary pawl clutch on the motor shaft, which is lockable to prevent movement of the cable.

The reciprocating component also has a counterweight that provides tension on the cable, relieving the motor of this function. The distance between the two cables is adjustable to allow for the use of dumbbells and varying lengths of barbells. A disadvantage of this design is that the spotting apparatus is not compact and modular. The entire machine must be assembled by the producer and shipped as a single unit. Also, the apparatus cannot be easily integrated into existing exercise equipment, requiring a large capital investment by the manufacturer in creating a dedicated production line. These factors contribute to the high retail price and low regional availability of such a product.

A person skilled in the art may realize that a motor drive is not strictly necessary for a cable-based self-spotting device. The main function of the machine is to prevent the weight from falling on the lifter. Therefore, it is sufficient to have a system that simply provides tension on the cable during the set and then holds the weight in place after the lifter reaches the point of exhaustion. This is the reasoning behind U.S. Pat. No. 6,893,381. It is similar to No. 6379287 mentioned earlier, in that it has a cable attached to a reciprocating drive that turns an endless chain. It does not, however, have a rotary pawl clutch on the motor. It instead uses pawls that fit into the links of the chain. When the lifter closes the barbell-mounted switch, a solenoid retracts the pawl from the chain. When the lifter releases the switch, the pawl is re-engaged through spring pressure. Thus the mechanism that arrests the downward motion of the weight is independent of the motor. If power-raising of the weight is desired, the lifter can control the motor separately. The consumer and the manufacturer can choose whether to spend money on a power-raising feature. However, the shortcomings of this apparatus are identical to those of U.S. Pat. No. 6,379,287. It is not compact, modular, nor inexpensive to produce.

In light of these attempts at creating a self-spotting machine that works better than a power rack or a smith machine while being commercially viable, there remains a need for a self-spotter that is compact, modular, and inexpensive to produce.

SUMMARY

In accordance with one embodiment, this innovative self-spotter comprises a cable that is attached to a weight assembly on one end and to a rotating drum on the other. The drum is mounted in a modular enclosure and has a ratchet that prevents unintended downward motion; the ratchet pawl is controlled by the lifter via a mechanical lever that is mounted on the barbell. Cable tension is maintained by a spiral torsion spring inside the drum. In this embodiment, two of these units are mounted on a bench press that holds them above the lifter at a suitable height.

DRAWINGS

Figures

In the drawings, closely related figures have the same number but different alphabetic suffixes.

Figure 10A:
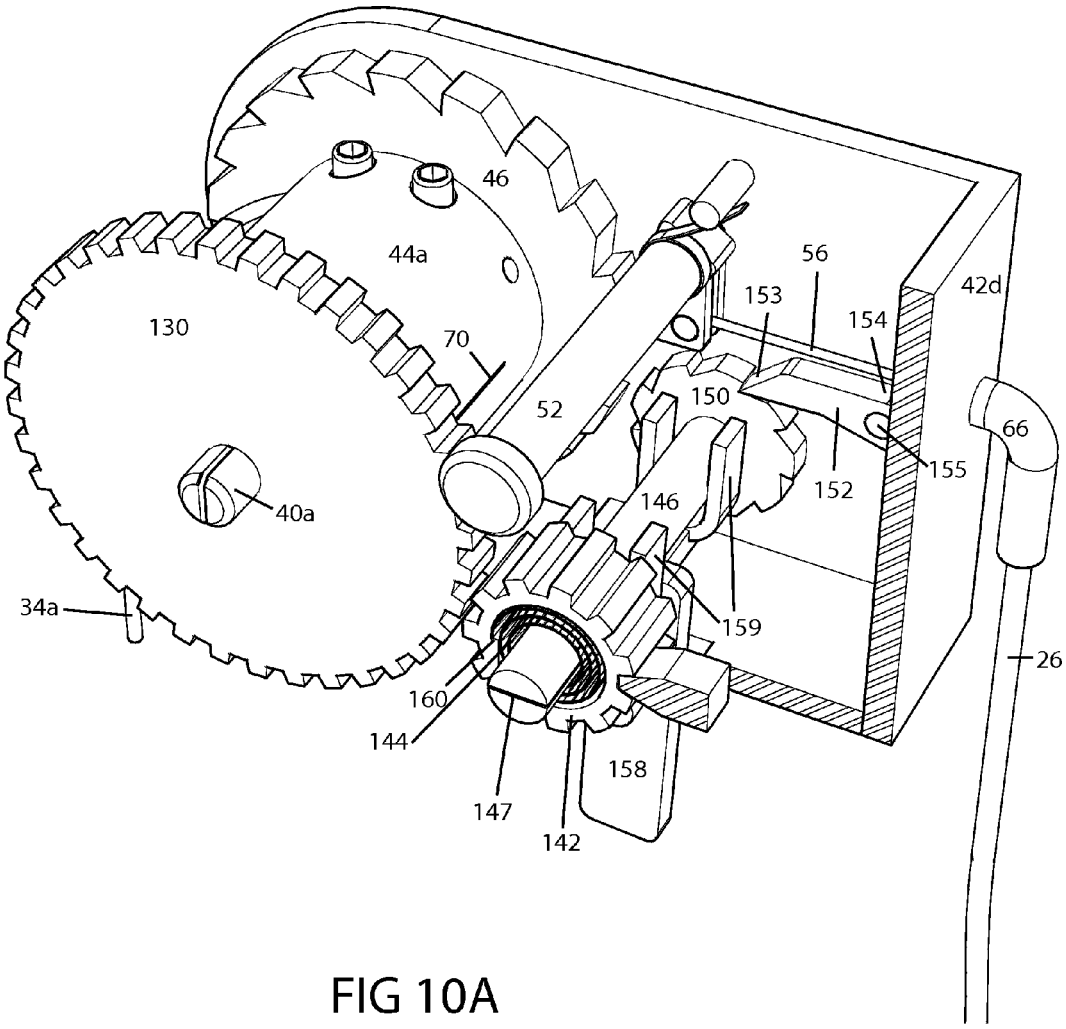
Figure 10B:
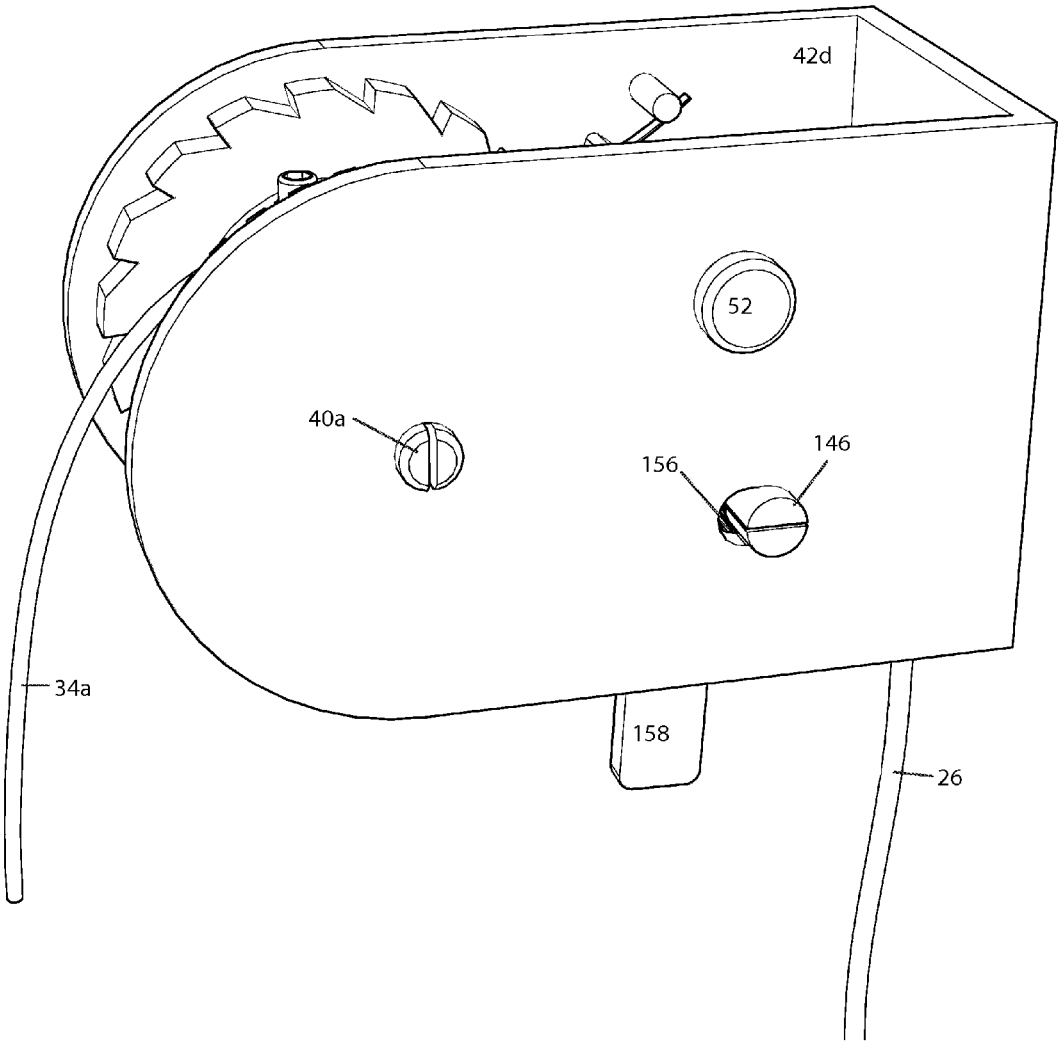
Figure 10C:
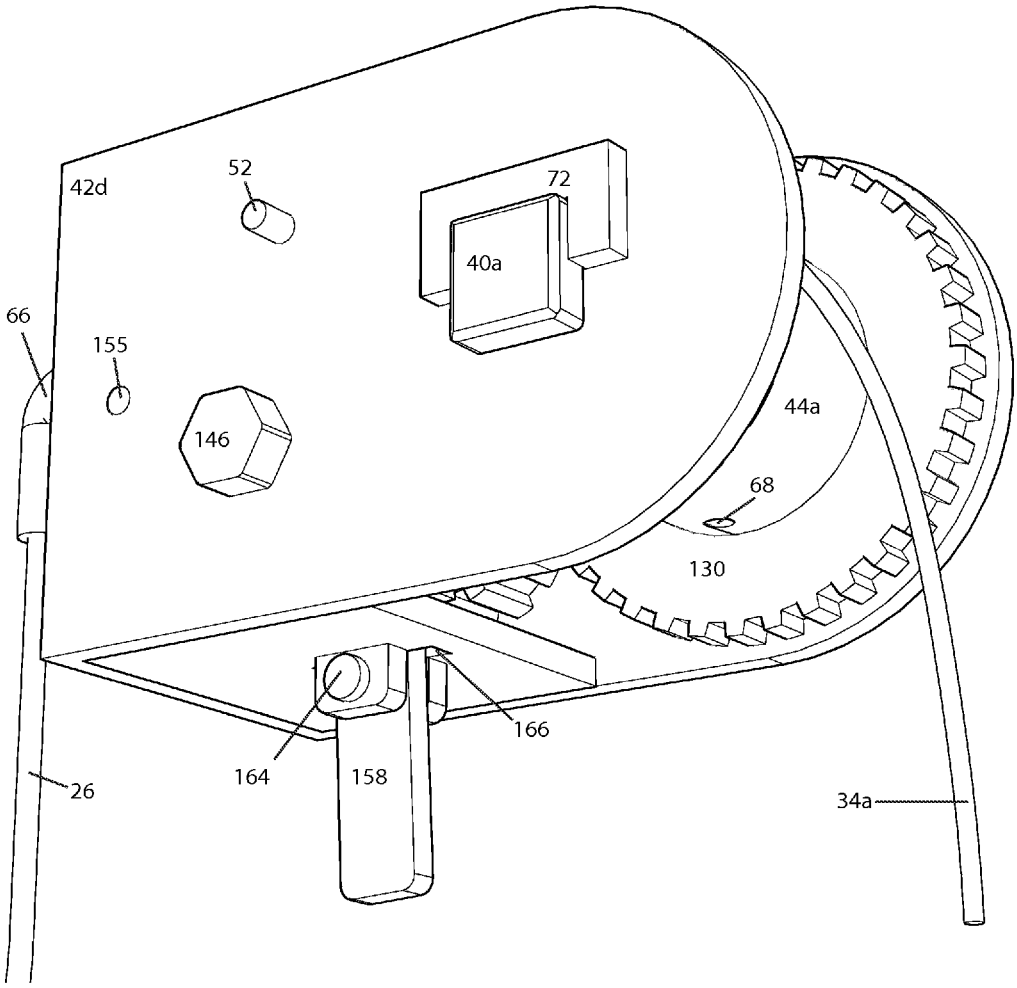

FIGS. 10A, 10B, and 10C show the self-spotting device with a spring assist mechanism in accordance with another embodiment.

Figure 11:
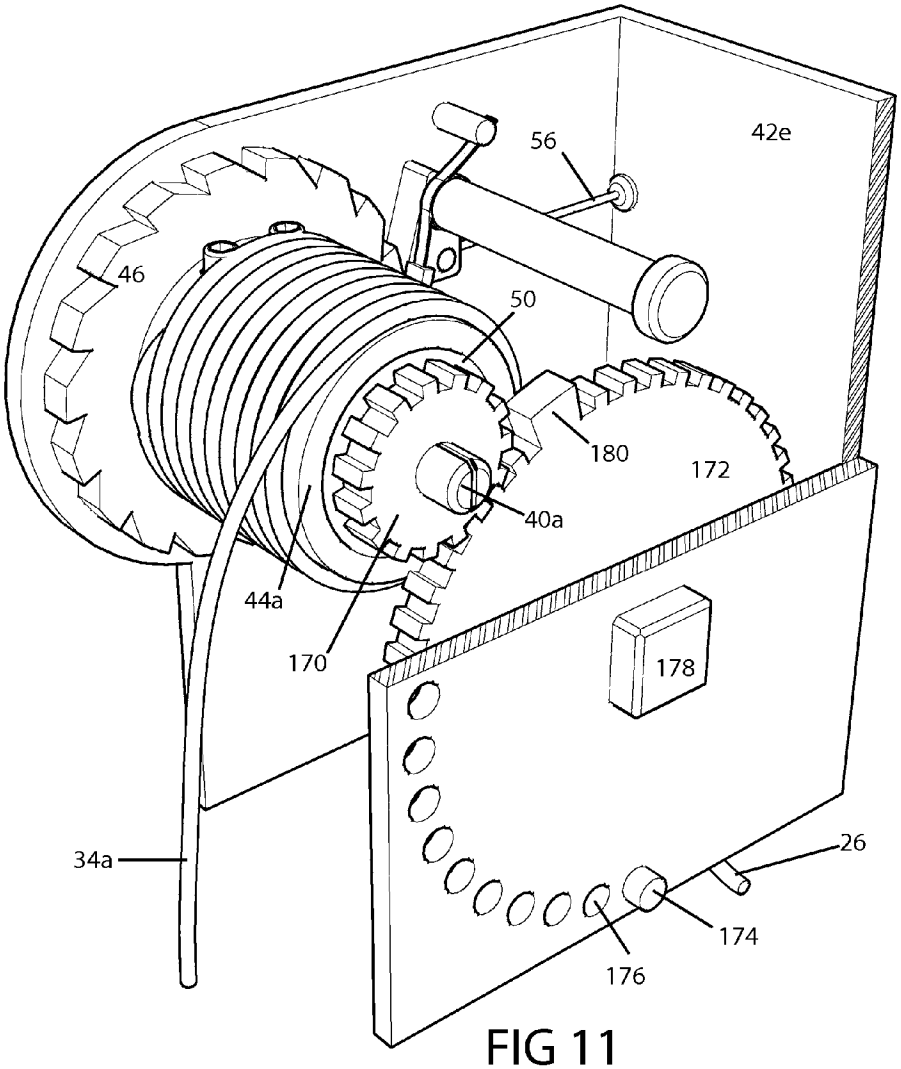

FIG. 11 shows the self-spotting device with a mechanism that limits the downward travel of the weight to a user-determined level.

Figure 12:
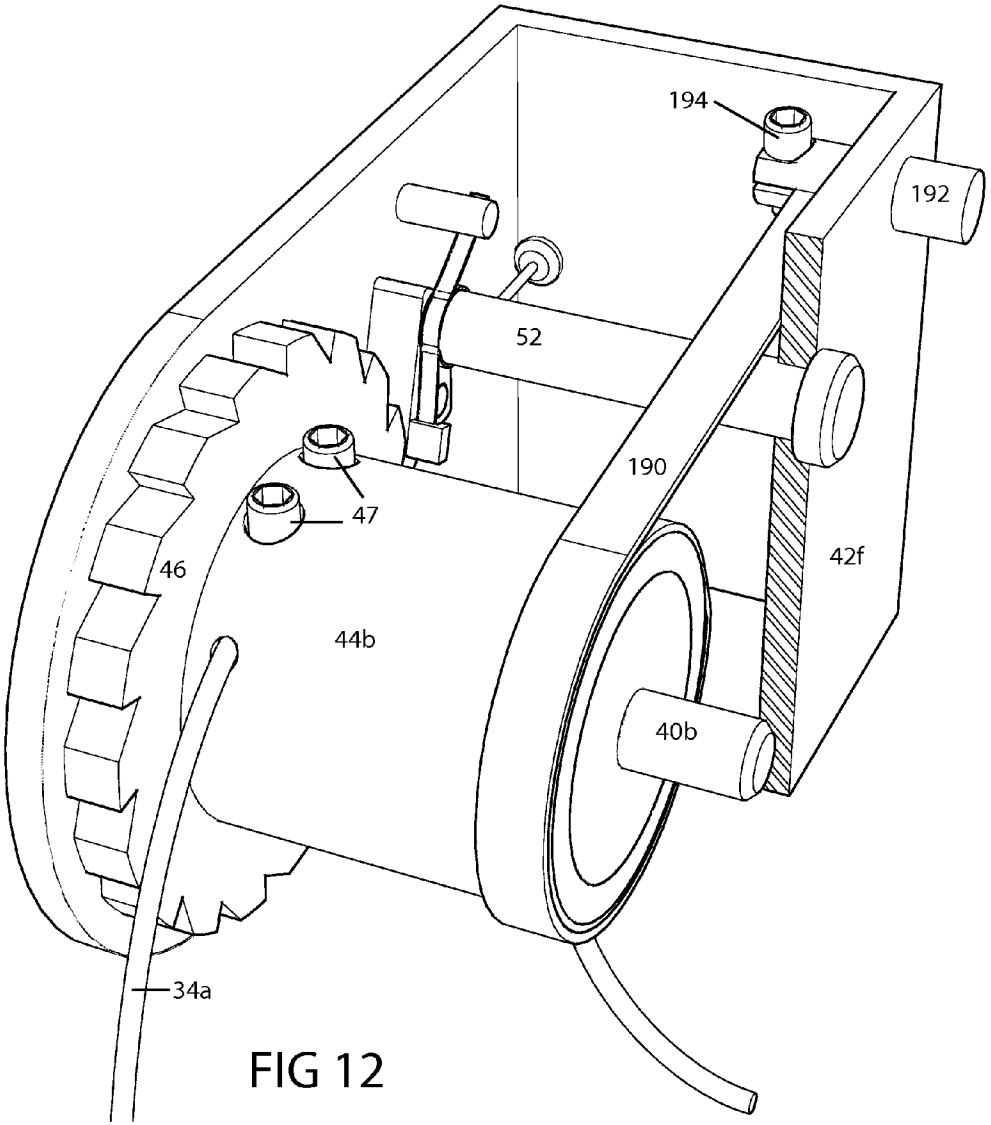

FIG. 12 shows the self-spotting device with a rubber band used to provide tension on the weight support cable.

Figure 13:
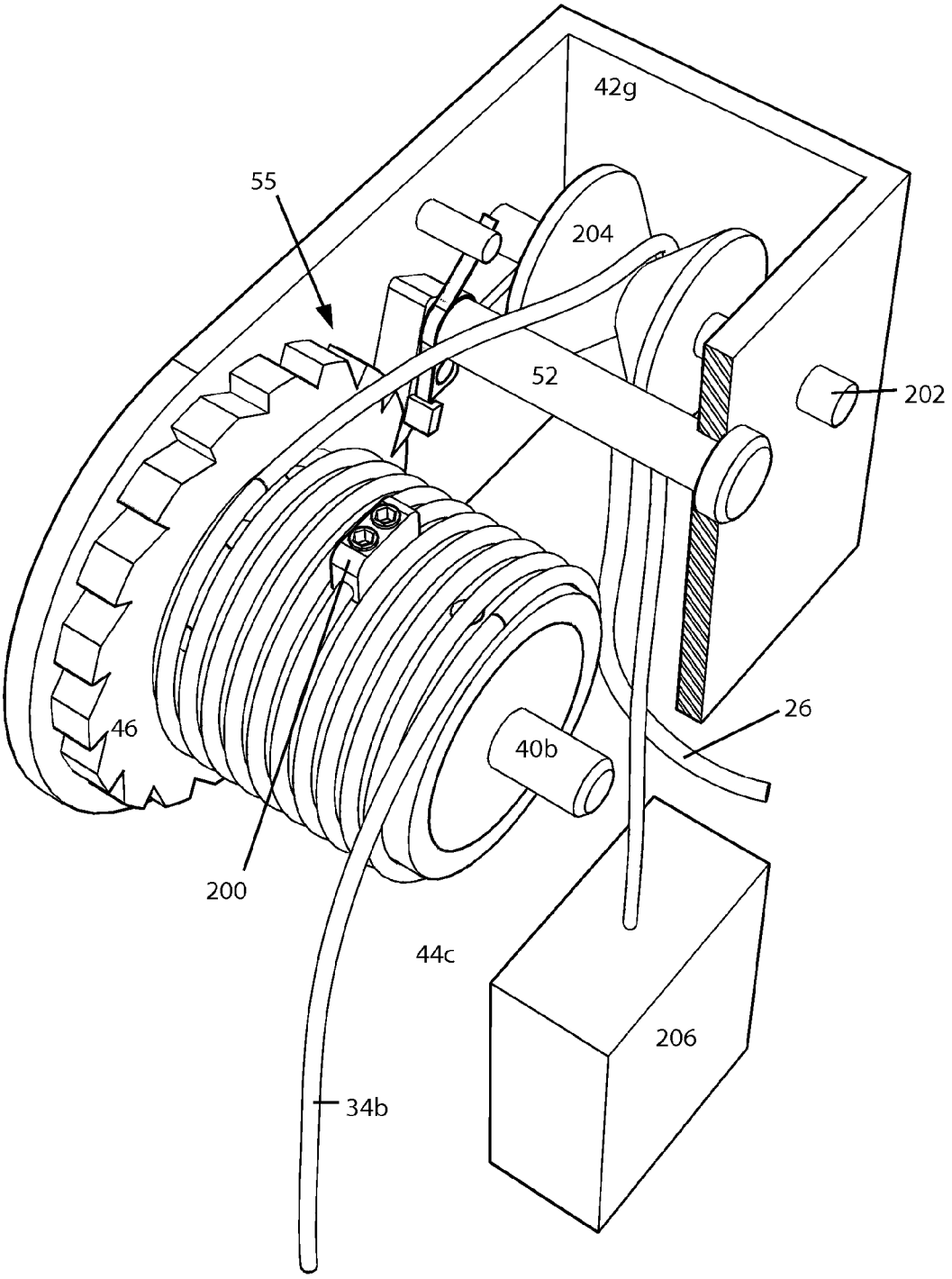

FIG. 13 shows the self-spotting device with a counterweight used to provide tension on the weight support cable.

Figure 14:
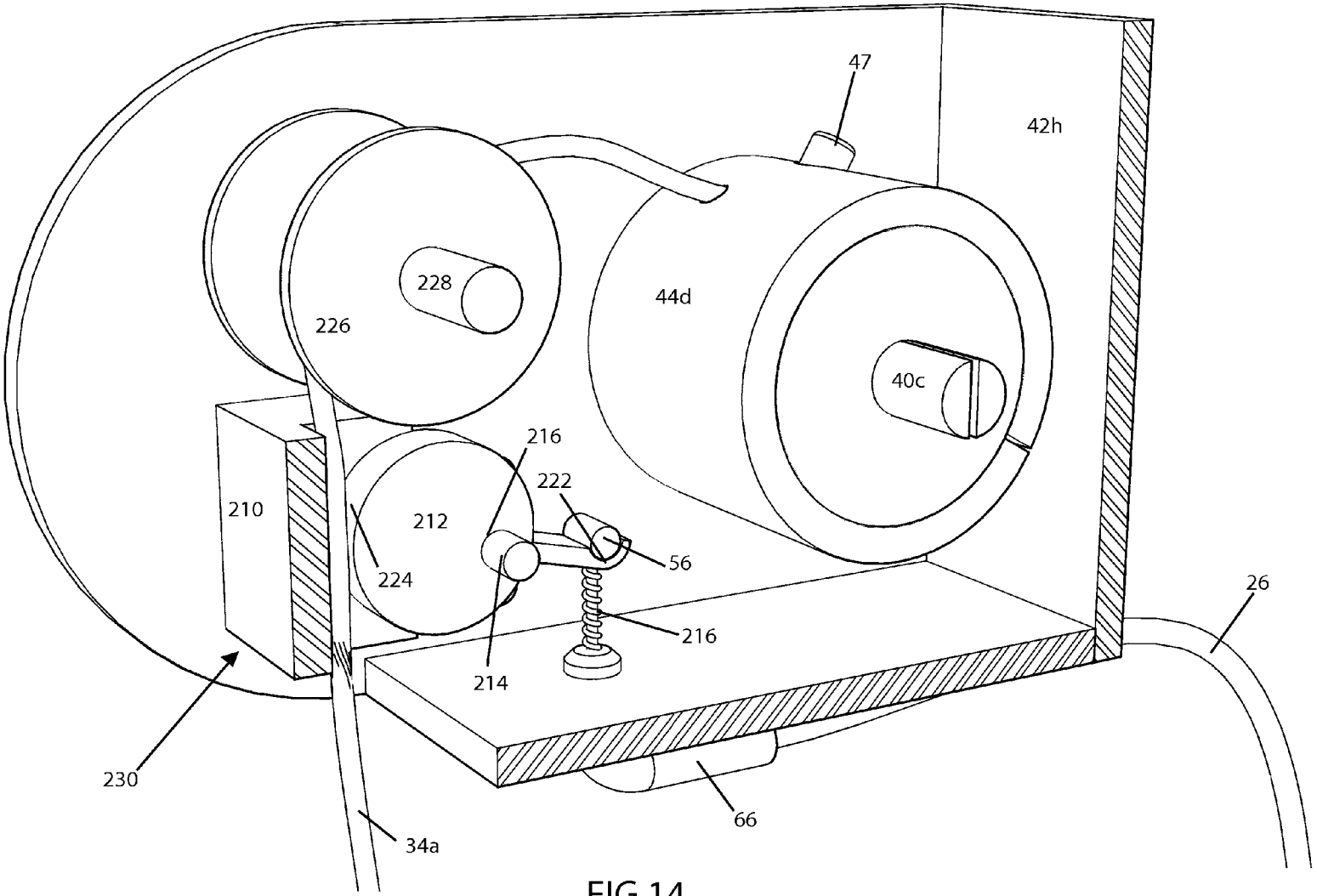

FIG. 14 shows the self-spotting device using a cam-locking mechanism rather than a ratchet gear.

| DRAWINGS - Reference numerals | |
|---|---|
| 20 | modular self-spotter unit |
| 22 | mounting adapter |
| 24 | barbell |
| 26 | cable housing |
| 28 | mechanical control unit |
| 30 | bench press |
| 32 | barbell attachment |
| 34a | weight support cable |
| 34b | weight support cable (counterweight embodiment) |
| 40a | cable drum axle |
| 40b | cable drum axle (counterweight and elastic recoil embodiments) |
| 40c | cable drum axle (cam-lock embodiment) |
| 41 | longitudinal slot |
| 42a | case (mechanical embodiment) |
| 42b | case (electrical embodiment) |
| 42c | case (motor assist embodiment) |
| 42d | case (spring assist embodiment) |
| 42e | case (limiter embodiment) |
| 42f | case (elastic recoil embodiment) |
| 42g | case (counterweight embodiment) |
| 42h | case (cam-lock embodiment) |
| 44a | cable drum |
| 44b | cable drum (elastic recoil embodiment) |
| 44c | cable drum (counterweight embodiment) |
| 44d | cable drum (cam-lock embodiment) |
| 46 | toothed ratchet wheel |
| 47 | cable retaining bolt |
| 48 | drum recoil spring |
| 50 | drum bushing |
| 52 | pawl pin |
| 54 | ratchet pawl |
| 55 | ratchet (comprised of 54, 46, 64, and 52) |
| 56 | control cable |
| 58 | pawl pin through-hole |
| 60 | pawl pin end-hole |
| 62 | spring stop |
| 64 | pawl torsion spring |
| 66 | control cable guide |
| 68 | bushing pin |
| 70 | recoil spring slot |
| 72 | axle stop |
| 74 | hole |
| 76 | cable hole |
| 80 | power rack |
| 90a | control lever (mechanical) |
| 90b | control lever (electrical) |
| 92 | lever pin |
| 94 | control unit clamp |

-continued

| DRAWINGS - Reference numerals | |
|---|---|
| 96 | barrel adjusters |
| 98a | control unit casing (mechanical) |
| 98b | control unit casing (electrical) |
| 100 | control unit clamp bolt |
| 102 | electrical control wire |
| 104a | normally extended solenoid |
| 104b | remote-controlled solenoid |
| 105 | antenna |
| 106 | normally open switch |
| 112 | normally open push-button switch |
| 114 | wireless remote sender |
| 116 | wireless control unit casing |
| 118 | control unit antenna |
| 120 | centripetal lock bushing |
| 122 | centripetal locking pawl |
| 124 | pin |
| 126 | pawl bias spring |
| 128 | toothed centripetal locking ring |
| 130 | drum gear |
| 132 | electric motor |
| 134 | motor gear |
| 142 | hollow gear |
| 144 | spiral torsion spring |
| 146 | spring assist pin |
| 147 | longitudinal slot |
| 148 | gear lock |
| 150 | toothed ratchet wheel |
| 152 | ratchet pawl |
| 153 | proximal end of pawl |
| 154 | distal end of pawl |
| 155 | pin |
| 156 | slotted hole |
| 158 | spring assist engagement fork |
| 159 | U-shaped prongs |
| 160 | notch |
| 164 | mounting bolt |
| 166 | narrow slotted hole |
| 170 | small drum gear |
| 172 | large limiter gear |
| 174 | limiter pin |
| 176 | limiter hole |
| 178 | gear axle |
| 180 | limiter gear protrusion |
| 190 | rubber band |
| 192 | clamp pin |
| 194 | bolt |
| 200 | cable clamp |
| 202 | pulley axle |
| 204 | cable pulley |
| 206 | counterweight |
| 210 | cam plate |
| 212 | cam |
| 214 | pin |
| 216 | coil spring |
| 217 | pivot hole |
| 222 | notch |
| 224 | friction surface |
| 226 | cable pulley |
| 228 | pulley axle |
| 230 | cam mechanism (comprised of 210, 212, 214, and 224) |

DETAILED DESCRIPTION

FIGS. 1, 2*a*, 2*b*, 3—First Embodiment

Figure 1:
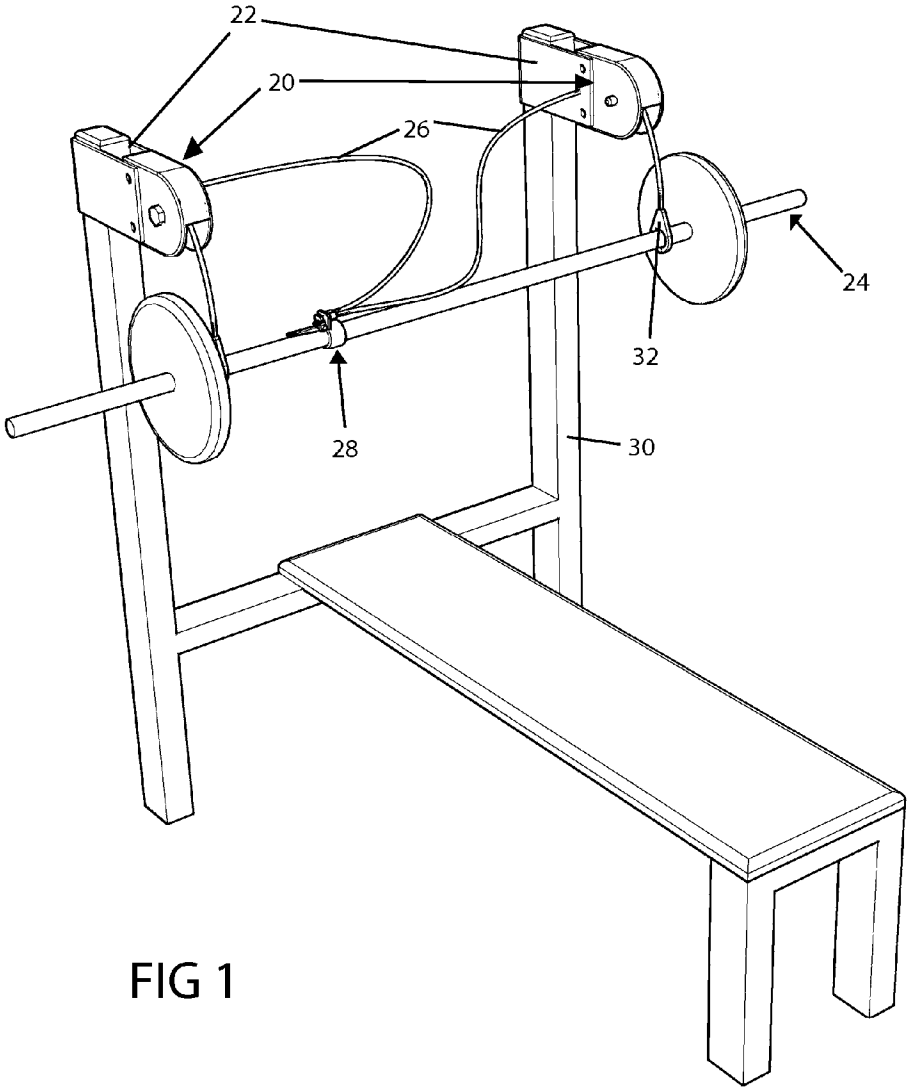
FIG. 1 shows a mechanical embodiment of my self-spotting device installed on a bench press.

FIG. 1 illustrates a mechanically-controlled dumbbell and barbell safety spotting apparatus made in accordance with my self-spotting device. Modular self-spotter units 20 are attached to a bench press 30 with mounting adapters 22. Weight support cables 34 extend from the self-spotter units and are attached to a barbell 24 with barbell attachments 32. The action of the self-spotter units is controlled by a mechanical control unit 28.

Figure 2A:
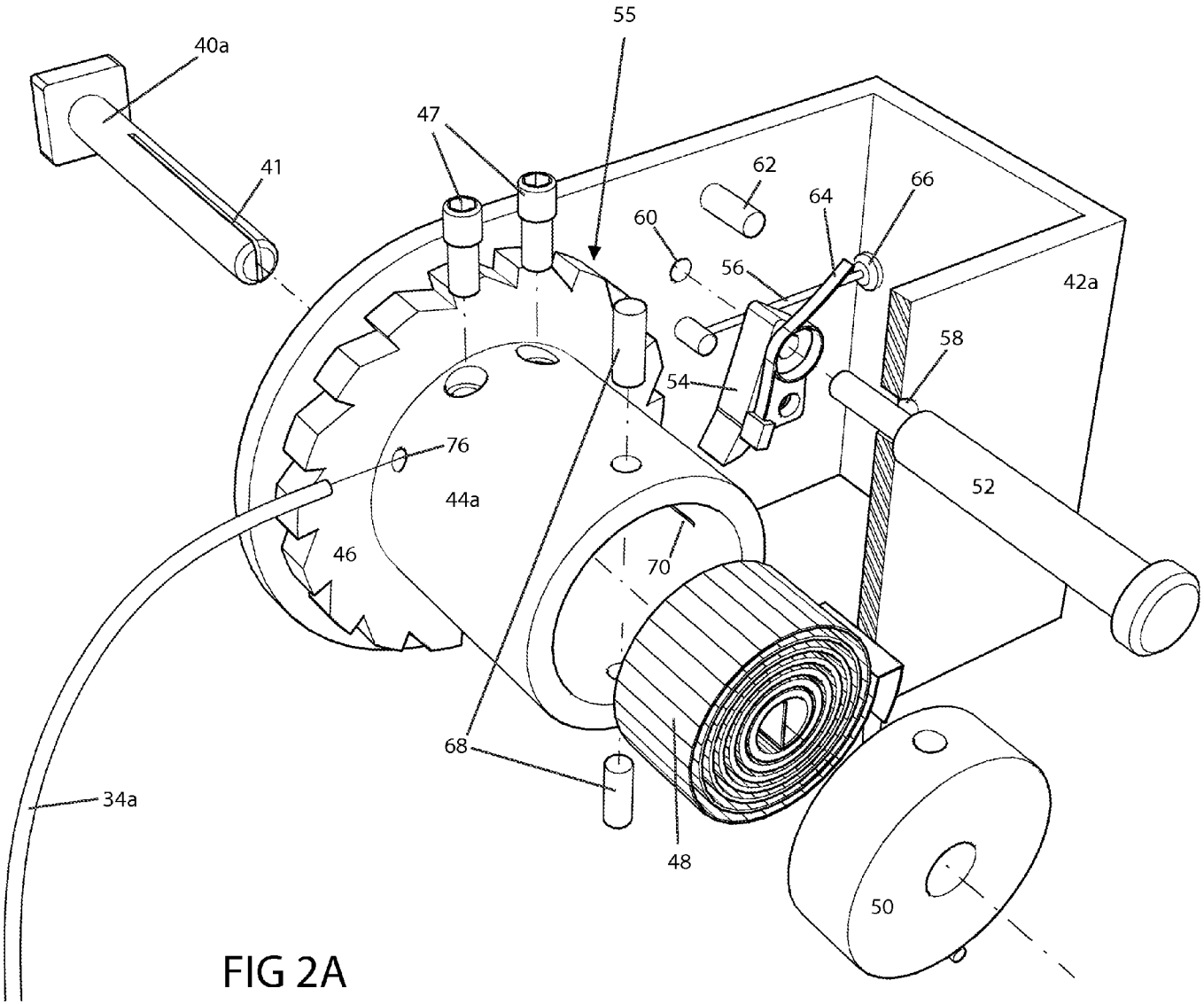
FIGS. 2A and 2B show an exploded view of the mechanical embodiment of the self-spotting device.
Figure 2B:
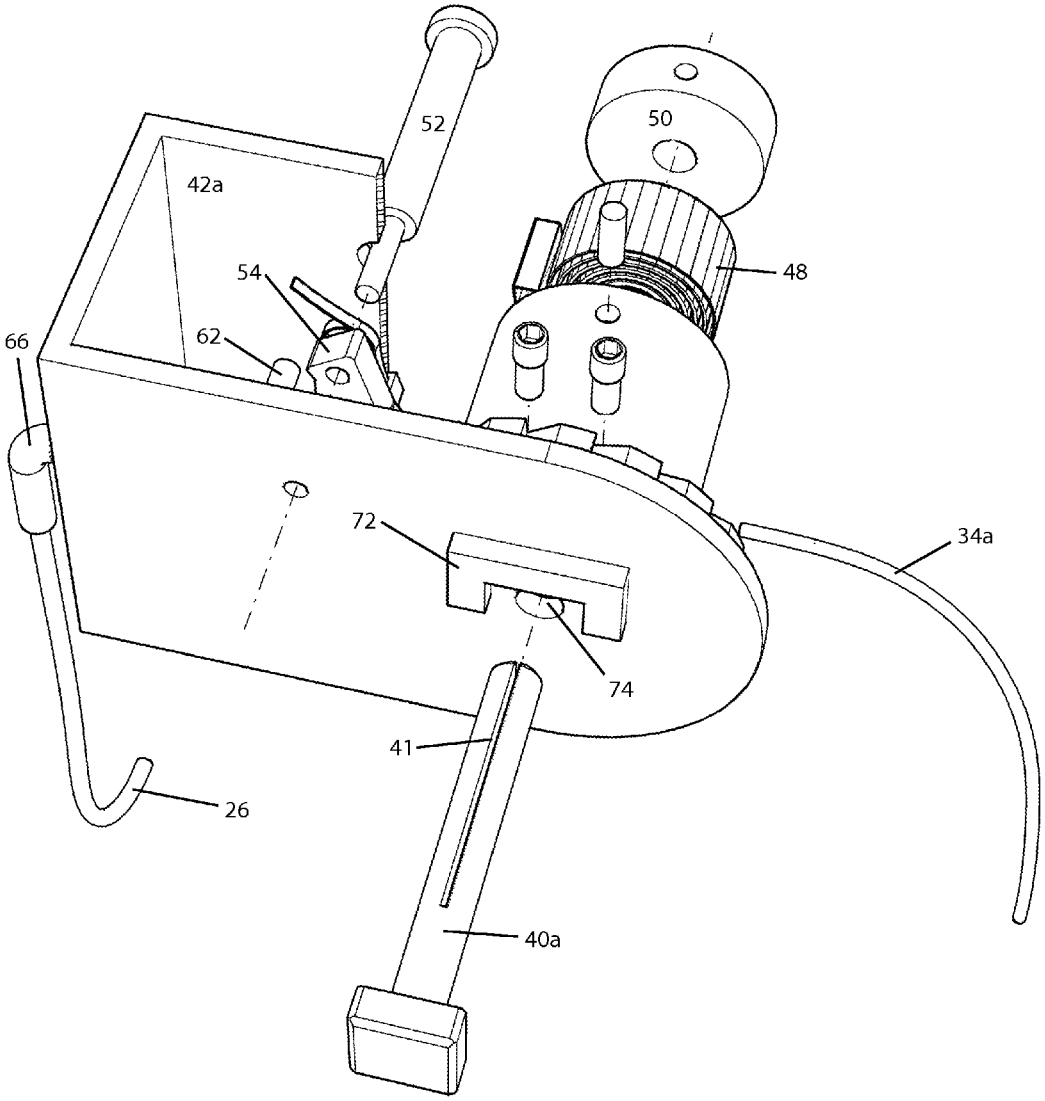

FIGS. 2A and 2B illustrate a mechanical embodiment of the self-spotter unit 20. A cable drum axle 40*a* extends through a hole 74 in a case 42*a*, a toothed ratchet wheel 46, a cable drum 44*a*, a drum recoil spring 48, and a drum bushing 50. The drum 44*a* should be of sufficient diameter such that the cable 34*a* is able to be wrapped around it without the cable 34*a* containing elastic force. A drum diameter of at least four inches is suitable when using ⅛" diameter 7×19 galvanized steel wire rope. However, other combinations may prove to be satisfactory. The drum 44*a* should be constructed of a light but strong material in order to minimize rotational inertia. Excess rotational mass would prevent the device from being able to react quickly to slack in the weight support cable 34*a*. At present I contemplate that steel, magnesium, aluminum, or fiber-reinforced plastic (FRP) would be suitable but other materials may prove to be satisfactory. A longitudinal slot 41 in the axle 40*a* engages the recoil spring 48. The recoil spring 48 is illustrated as a spiral torsion spring. When the axle 40*a* is in place, it is prevented from turning by an axle stop 72. Bushing pins 68 secure the bushing 50 inside the drum 44*a*. The recoil spring 48 engages the drum 44*a* through a recoil spring slot 70. A ratchet pawl 54 is held in place by a pawl pin 52. A pawl torsion spring 64 has one end engaged on the pawl 54 and the other on a spring stop 62. The spring 64 ensures that the pawl 54 is normally engaged against the ratchet wheel 46. A ratchet 55 is comprised of the toothed ratchet wheel 46, the ratchet pawl 54, the pawl torsion spring 64, and the pawl pin 52. A control cable 56 passes through a control cable guide 66 and a cable housing 26. Cable 34*a* is wrapped around drum 44 and securely fastened in a cable hole 76 with cable retaining bolts 47.

Figure 3:
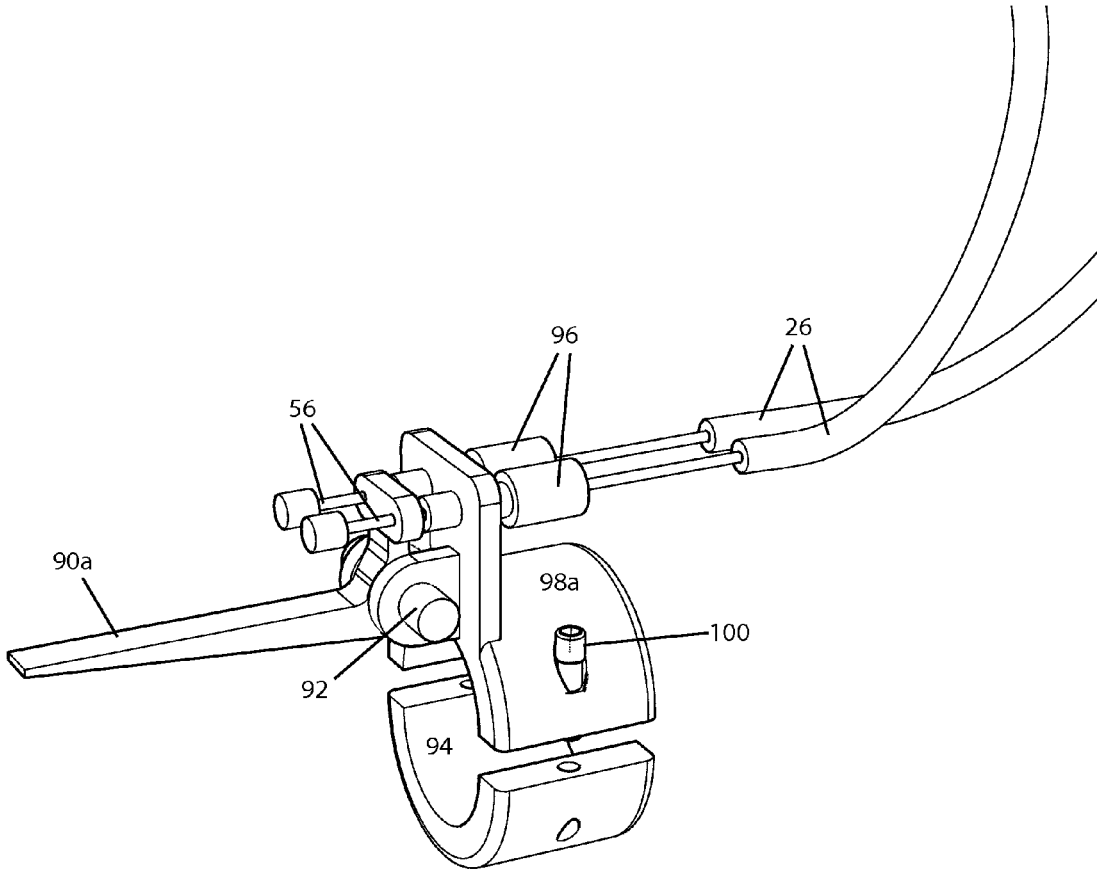
FIG. 3 shows a control unit for the mechanical embodiment of the self-spotting device.

FIG. 3 illustrates mechanical control unit 28. It comprises a control unit casing 98*a*, a control unit clamp 94, and two control unit clamp bolts 100. The control unit 28 is clamped to the barbell 24 as seen in FIG. 1. There is a control lever 90*b* that is pivotably attached the casing 98 with a lever pin 92. The control cables 56 extend through holes in lever 90*b*. Cables 56 have ends that are larger than the holes in lever 90*b* so that they cannot pass through it. Cables 56 also pass through barrel adjusters 96 and the cable housings 26. The adjusters 96 are threaded into threaded holes in the casing 98*a* to allow for adjusting the tension in the control cables 56.

OPERATION

Referring to FIG. 2B, a user preloads the recoil spring 48 by turning axle 40*a* counterclockwise. When the required spring tension is achieved, the pin 40 is pushed further into the hole so that the head of the pin 40 is held from turning by stop 72. Referring also to FIG. 1, the user lies on his back on the bench press 30 and grasps the barbell 24 with both hands. Referring also to FIG. 3, he or she supports the weight of the barbell and squeezes the control lever 90*b*. The lever 90*b* pulls on the control cables 56 which overcome the tension of the pawl torsion spring 64. The pawl 54 disengages from the ratchet wheel 46 allowing the drum 44*a* to turn. This allows weight support cable 34*a* to spool off the drum 44*a* and allows the user to lower the barbell 24 toward his or her chest, following normal bench pressing procedure. The user lifts the barbell back up and performs a number of repetitions. The recoil spring 48 keeps the support cable 34*a* taut.

When the user is approaching the point of exhaustion and has the barbell 24 in a lowered position, he or she may be unsure whether he or she will be able to lift it all the way up. He then releases the control lever 90*b*. The ratchet pawl 54 then re-engages the ratchet wheel 46. Now the barbell 24 is only able to travel upwards because the cable drum 44*a* will only turn in the direction that retracts the cable 34*a*. The user now lifts the barbell 24 with as much force as he or she can muster. When the barbell 24 is raised up, the drum recoil spring 48 provides rotational force to the drum 44*a*, allowing it to respool the cable 34*a*. The barbell 24 will be safely held by the cable 34*a* at the maximum height that he or she is able to reach.

ALTERNATIVE EMBODIMENTS

Description

FIG. 4

Figure 4:
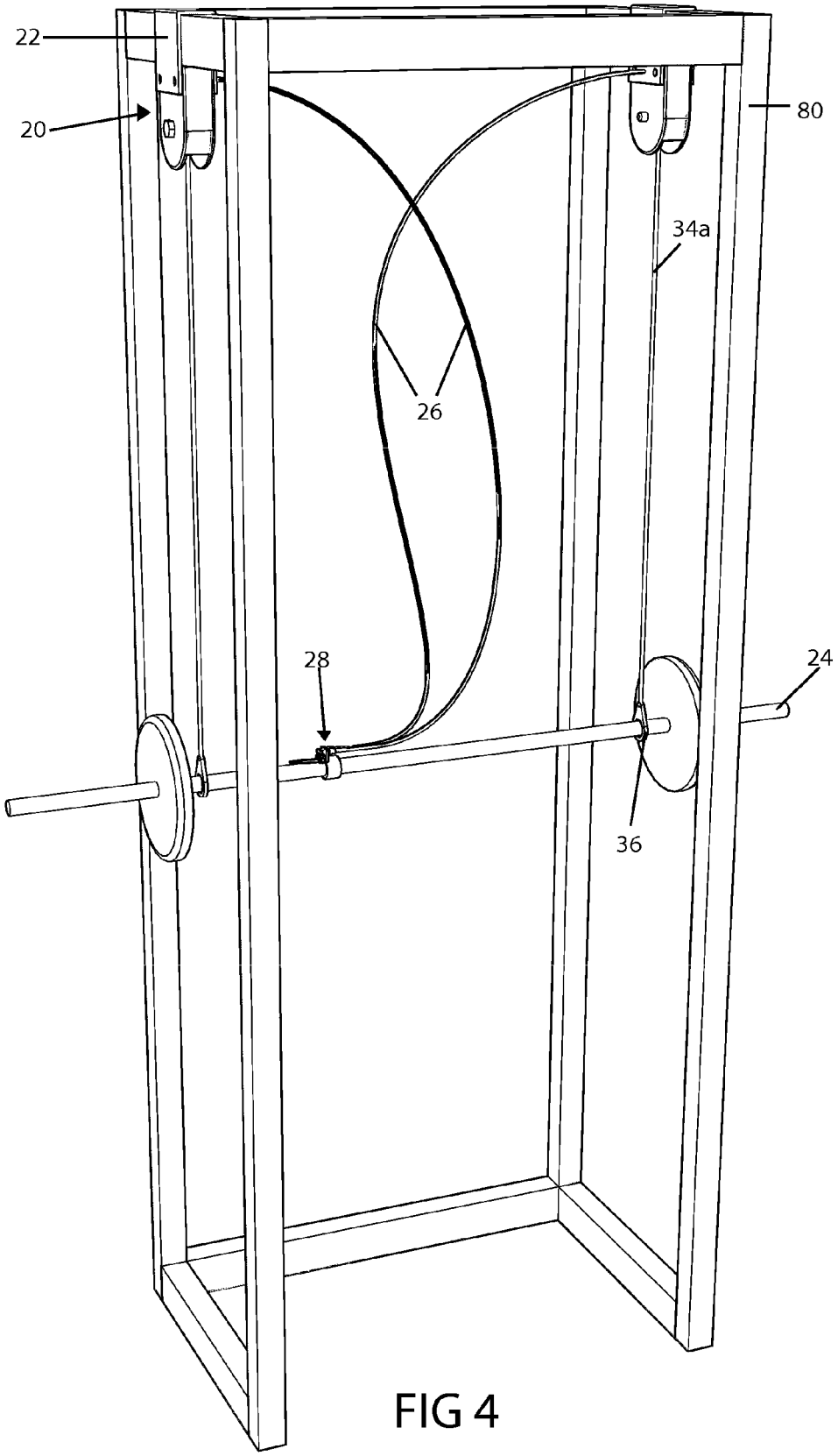
FIG. 4 shows a mechanical embodiment of the self-spotting device installed in a power rack.

FIG. 4 illustrates another application of my self-spotting device. The modular units 20 are mounted in a power rack 80 with the mounting adapters 22. For use with dumbbells or a narrower barbell, the modular units 20 can be mounted closer together.

OPERATION

In this embodiment, the user can safely perform squats without a spotter. If he stumbles or is unable to reach a standing position, he once again releases control lever 90*b* and the barbell will remain safely supported by cable 34*a*. He can also perform military or shoulder presses as long as the power rack 80 is sufficiently tall. The user can also place a flat bench (not shown) inside the power rack and perform bench presses.

DESCRIPTION

Figure 5A:
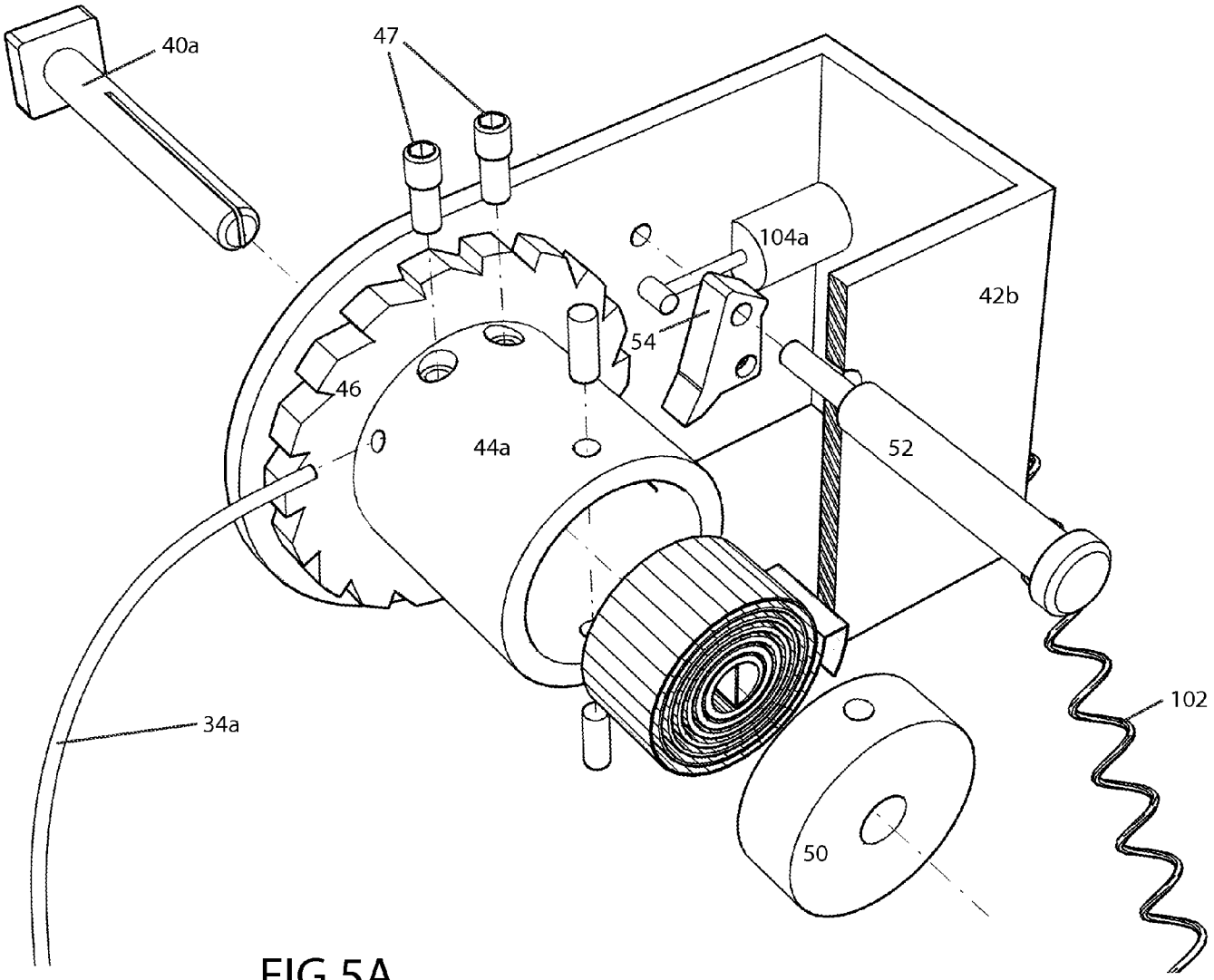
FIG. 5A shows an electrical embodiment of the self-spotting device.
Figure 6:
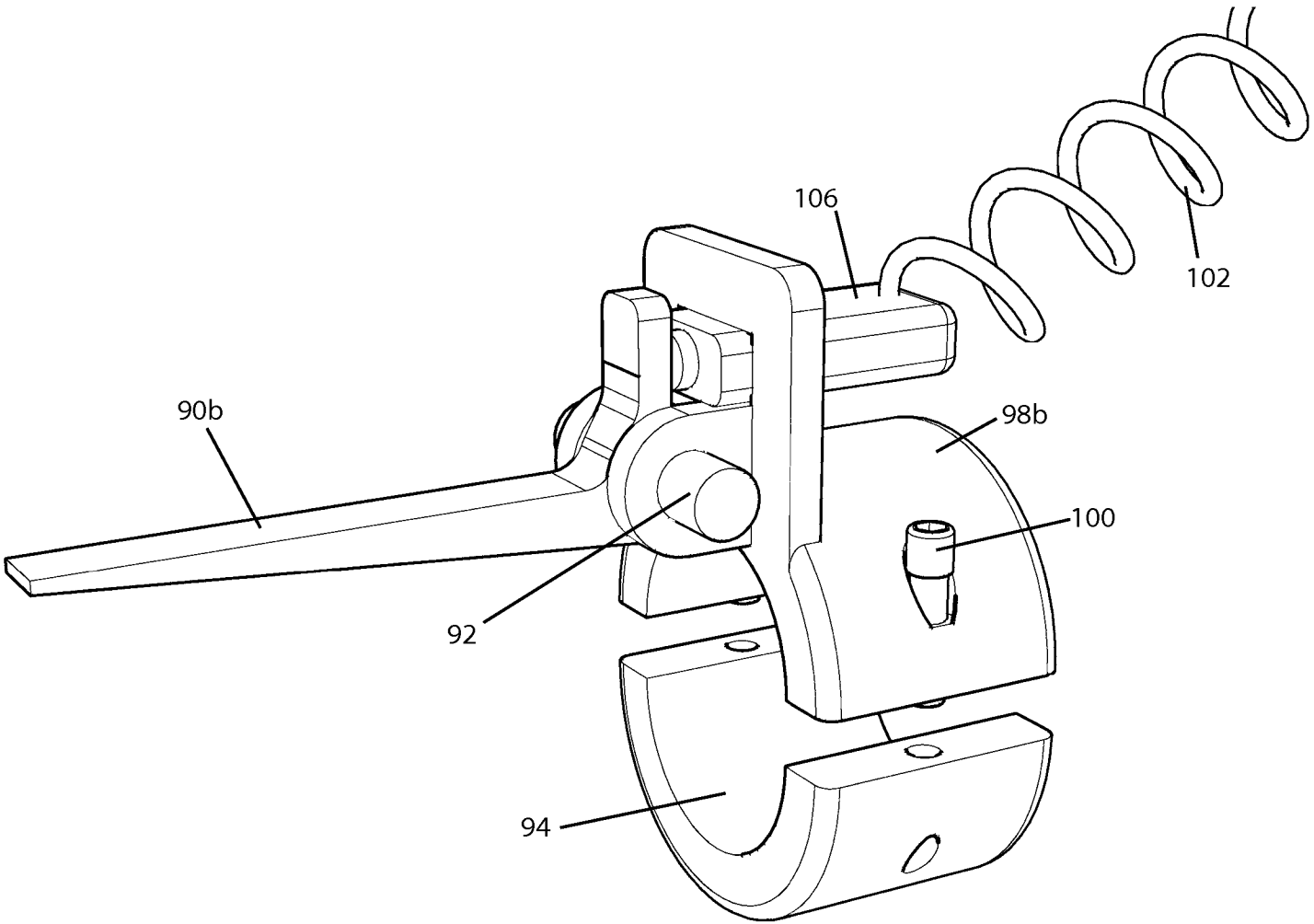
FIG. 6 shows a control unit for the electrical embodiment of the self-spotting device.

FIGS. 5A and 6

FIGS. 5A and 6 illustrate an electrically-operated embodiment of my self-spotting device. There is a normally extended solenoid 104*a* mounted in the case 42*b* and attached to the ratchet pawl 54. The solenoid 104*a* is operated by an electrical control unit, as illustrated in FIG. 6. Instead of the control cables 56, there is a normally open switch 106. It is mounted in a control unit casing 98*b* and actuated by an electrical control lever 90*b*. It is connected to the solenoid 104 by an electrical control wire 102.

OPERATION

When the solenoid 104*a* is not actuated, it pushes the pawl 54 forward to engage the ratchet wheel 46. When the user squeezes lever 90*b*, the solenoid 104*a* is actuated. This retracts and disengages the pawl 54. In reference to FIG. 1, this allows the cable 34*a* to spool out and lets the user lower the barbell 24.

DESCRIPTION

Figure 5B:
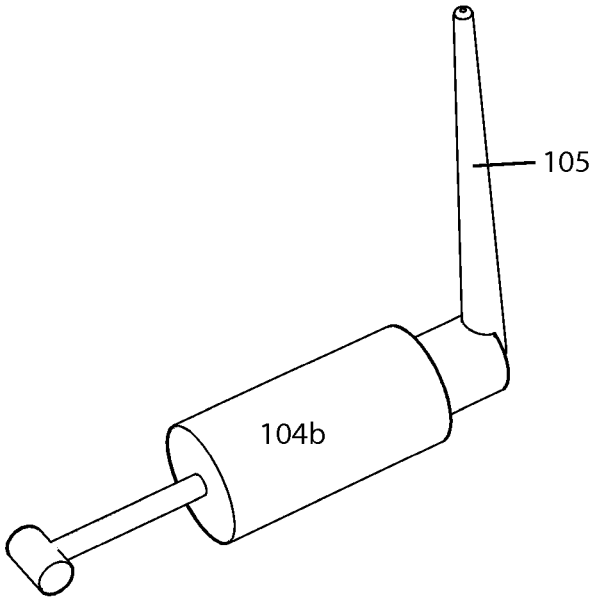
FIG. 5B shows a wireless option for the electrical embodiment of the self-spotting device.
Figure 7:
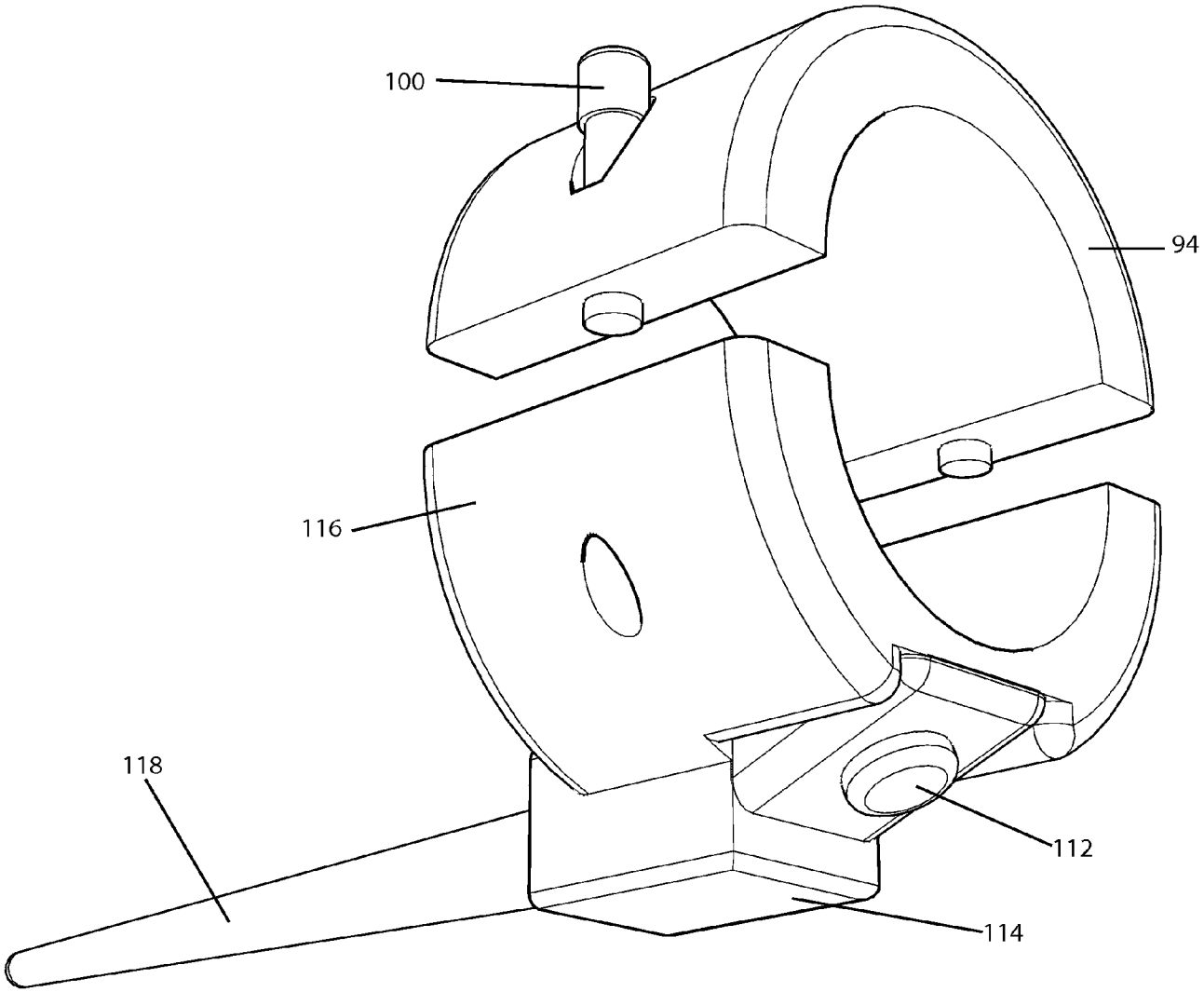
FIG. 7 shows a control unit for the wireless option of the electrical embodiment of the self-spotting device.

FIGS. 5B and 7

FIG. 5B illustrates a remote-controlled solenoid 104*b* for use in the electrically-operated self-spotting device described in FIG. 5A. The solenoid 104*b* has an antenna 105. FIG. 7 illustrates a remote control unit for a wireless embodiment of my self-spotting device. It comprises a wireless control unit casing 116 and the control unit clamp 94. They are joined by the clamp bolts 100. There is a normally open push-button switch 112 and a wireless remote sender 114 with a control unit antenna 118.

OPERATION

Referring also to FIGS. 5A and 5B, the remote control unit is mounted to the barbell 24. When the user depresses the switch 112, the remote sender 114 transmits a signal to a remote-controlled solenoid 104*b* via antenna 105. The solenoid 104*b* disengages the ratchet 55, allowing the support cable 34*a* to extend.

DESCRIPTION

FIG. 8

Figure 8:
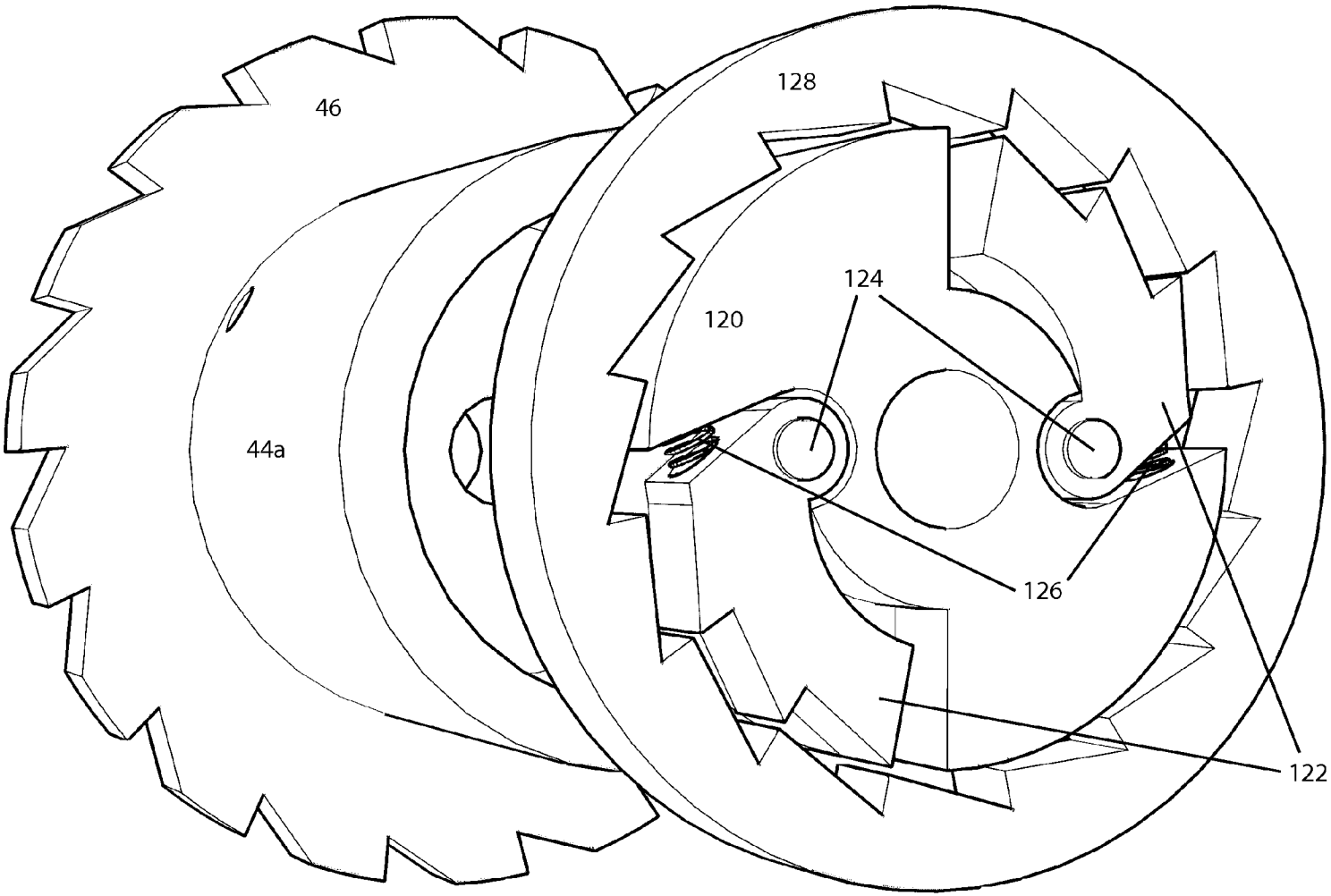
FIG. 8 shows a centripetal lock on the drum and ratchet mechanism in accordance with another embodiment.

FIG. 8 illustrates another embodiment of my self-spotting device. FIG. 8 shows the drum and ratchet components from any of the previous embodiments. The drum bushing 50 from FIG. 2A has been replaced with a centripetal lock bushing 120. There are two centripetal locking pawls 122 rotatably attached to the bushing 120 via two pins 124. Mounting holes are located at the ends of the pawls 122 such that it can swing outwards with centripetal force when the drum 44*a* unit rotates. A toothed centripetal locking ring 128 is immovably attached to the case 42. The teeth on the locking ring 128 are the inverse shape of the teeth on the locking pawls 124. There are pawl bias springs 126 disposed in between the pawls 122 and the bushing 120. The bias springs 126 bias the locking pawls 122 to be disengaged from the locking ring 128, allowing the bushing 120 and the drum 44*a* to freely rotate.

OPERATION

The centripetal locking mechanism provides additional safety to the user. Referring also to FIG. 1, the centripetal locking mechanism will arrest the downward travel of the barbell 24 if the cable 34*a* is pulled off the drum 44*a* at an unsafe speed. When the drum 44*a* is turning quickly, the centripetal force on the pawls 122 will overcome the force of the bias springs 126. The teeth on the pawls 122 will engage the teeth on the locking ring 128, stopping the rotation of the drum 44 and the downward movement of the barbell 24.

DESCRIPTION

FIG. 9

Figure 9:
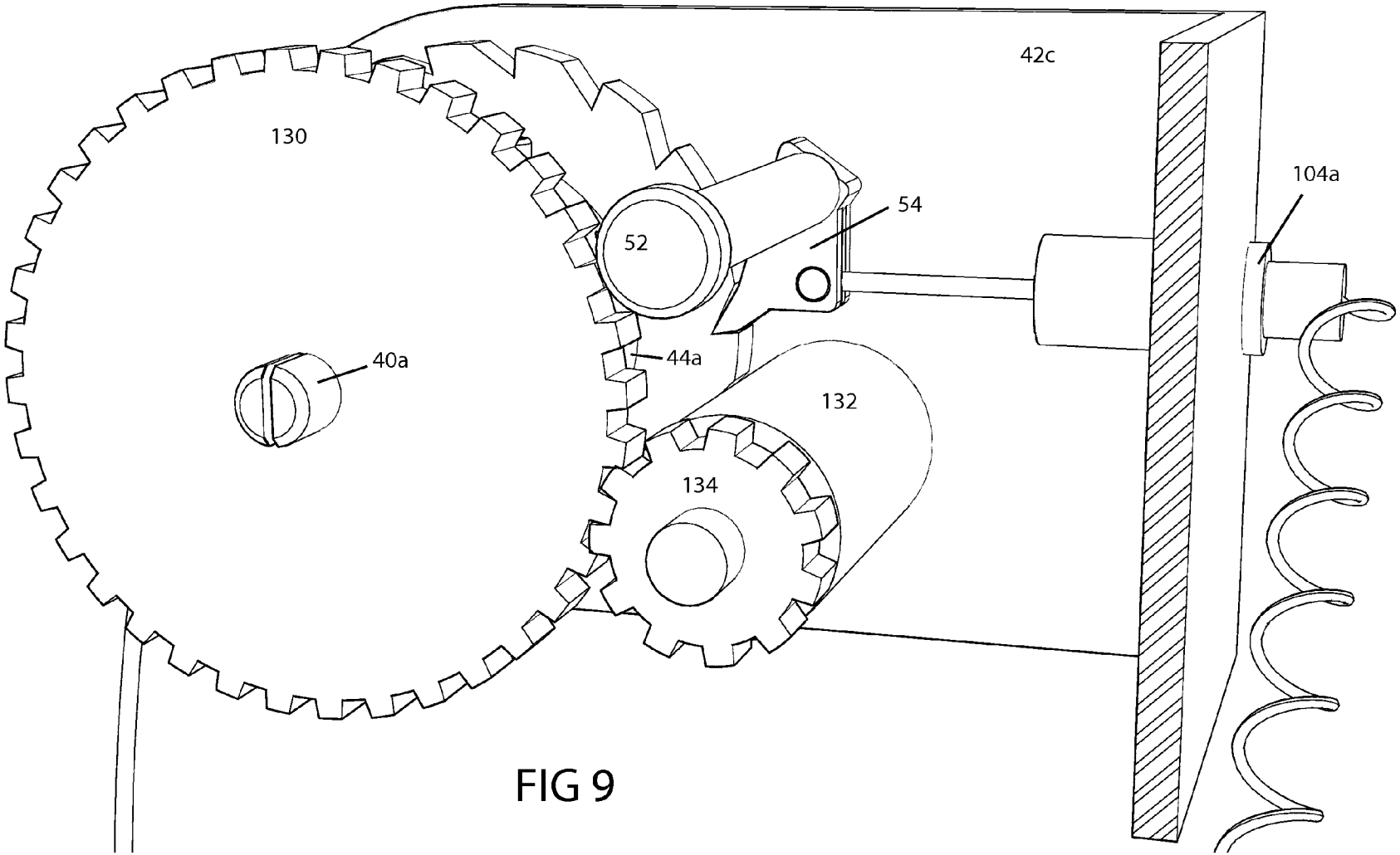
FIG. 9 shows the self-spotting device with a motor assist mechanism in accordance with another embodiment.

FIG. 9 illustrates another embodiment of my self-spotting device that incorporates a motor-assist mechanism. An electric motor 132 is mounted in a case 42*c*. There is a motor gear 134 attached to the motor shaft. It can be attached by a spline, a keyway, set screws or other means that will not allow rotation of the gear 134 on the motor shaft. The motor gear 134 meshes with a drum gear 130 that is solidly attached to the drum 44*a*. The motor gear 134 can be substantially smaller than drum gear 130 so as to provide a mechanical advantage to the motor. The motor 132 is not intended to hoist the full weight of the barbell 24 (in reference to FIG. 1) and can be small and lightweight. This is because when the user has reached the point of exhaustion, he or she will normally only need a slight amount of help to complete his last repetition. This is called a forced repetition.

OPERATION

When the user is unable to complete his or her last repetition, he or she presses a switch on the control unit (not shown) that engages the motor 132. The motor provides an upward force on the support cable 34*a* that is sufficient to allow the lifter to complete his or her last repetition. Preferably, this upward force would be in the range of twenty pounds. If the motor assist mechanism provides substantially more force than this then the motor will be prohibitively large, heavy, and expensive. If the motor assist mechanism provides substantially less than twenty pounds of assistance, then the user may not be able to perform the forced repetition.

DESCRIPTION

FIGS. 10A, 10B, and 10C

FIGS. 10A, 10B, and 10C illustrate another embodiment of my self-spotting device that incorporates a spring-assist mechanism. This mechanism provides the same function as the motor-assist in FIG. 9 but without using an electric motor. The drum gear 130 is the same as described in FIG. 9. It is solidly attached to the drum 44*a*. A spring assist pin 146 is inserted through a slotted hole 156 in the case 42*d*. There are two identical holes 156 on opposite sides of the case 42*d* but in FIG. 10A one side of the case 42*d* is omitted for clarity. A toothed ratchet wheel 150 is removeably attached to the pin 146. They can be attached by a spline, a keyway, set screws or by other means that will allow removal but not rotation between the two components. A ratchet pawl 152 has a proximal end 153 that engages the ratchet wheel 150 and a distal end 154. The distal end 154 is pivotably attached to the case 42*d* via a pin 155.

The pin 146 has a longitudinal slot 147 that engages a spiral torsion spring 144. The spring 144 is located inside a hollow gear 142. The spring 144 engages a notch 160 that is formed on the inside diameter of the gear 142. A gear lock 148 is immovably attached to the case 42*d*. It is a piece of metal with the profile of a truncated cone. It engages the teeth of the gear 142 to prevent it from turning. The distance between the gear lock 148 and the drum gear 130 is such that the hollow gear 142 cannot be simultaneously disengaged from both. The distance will also be such that, when the hollow gear 142 is fully engaged against the lock 148, it is completely disengaged from the drum gear 130. A spring assist engagement fork 158 is pivotably attached to the case 42*d* by a mounting bolt 164. The fork 158 passes through a narrow slotted hole 166 in the bottom of the case 42*d*. The fork 158 has two U-shaped prongs 159 that straddle the pin 146.

OPERATION

In reference to FIG. 10C: To prepare the system for use, the user rotates pin 146 clockwise using a wrench, hand-crank, or other means (not shown). In reference to FIG. 10A: As the pin 146 turns, the slot 147 engages and preloads spring 144. The ratchet wheel 150 and pawl 152 prevent the pin 146 from turning backwards. This maintains the preload on spring 144 while the user is completing a set of repetitions.

When the user is unable to complete his last repetition, he or she presses a foot pedal or other device (not shown) that operates a linkage (not shown) that operates the engagement fork 158. The fork 158 pivots about bolt 164 and the prongs 159 slide the pin 146 forward in the slotted hole 156. The teeth on the hollow gear 142 will partially engage the teeth on the drum gear 130 before being released from the gear lock 148. After the hollow gear 142 is released by the gear lock 148, the tension in the spring 144 is released, imparting rotational force through the hollow gear 142 through the drum gear 130 into the drum 44*a*. The circular force is then translated by the rotation of the drum 44*a* into an upward vertical force on the weight support cable 34*a*. This additional upward force aids the user in lifting the barbell 24 (in reference to FIG. 1). Before the user performs his or her next set of exercises using this embodiment, he or she must again preload the torsion spring 144 by turning the pin 146.

DESCRIPTION

FIG. 11

FIG. 11 illustrates another embodiment of my self-spotting device that incorporates a mechanism to allow the user to limit the downward travel of the barbell 24 (in reference to FIG. 1). A portion of the case 42*e* in FIG. 11 is cut away in order to better demonstrate the working principles of this embodiment. Immovably attached to the drum bushing 50 is a small drum gear 170. A large limiter gear 172 is rotatably attached to the case 42*e* with a gear axle 178. The limiter gear 172 is substantially larger than the drum gear 170. This is so that the drum 44*a* can spool out sufficient cable 34*a* for the barbell 24 to reach its lowered position while the limiter gear 172 makes less than one rotation. There is a plurality of limiter holes 176 in the wall of the case 42*e*. The holes 176 are located along a radius that is slightly larger than the radius of the limiter gear 172. There is a limiter pin 174 that is removeably inserted into one of the holes 176. There is a limiter gear protrusion 180 at one location on the outside circumference of the limiter gear 172. The protrusion 180 protrudes beyond the radius of the limiter holes 176.

OPERATION

When the barbell 24 is lowered, the cable 34*a* is spooled off the drum 44*a*. The drum 44*a* turns about the pin 40*a*. This imparts circular motion to the small gear 170 which, in turn, causes the large gear 172 to rotate about its axle 178. When the protrusion 180 reaches the limiter pin 174 the large gear 172 will cease turning. This will prevent the cable 34 from further extending from the spool 44. Thus the barbell 24 will stop its downward movement. The user can insert the limiter pin 174 into any of the limiter holes 176 in order to set a desired minimum height of the barbell 24.

DESCRIPTION

FIG. 12

FIG. 12 illustrates another embodiment of my self-spotting device that replaces the recoil spring 48 with a rubber band 190. One end of the rubber band 190 is secured by a bolt 194 to a clamp pin 192 that is affixed to the case 42*f*. The other end of the rubber band 190 is attached to a point on the outer circumference of the cable drum 44*b*.

OPERATION

When the barbell 24 is lowered, the cable 34*a* is spooled off the drum 44*b*. As the drum 44*b* turns, it stretches and stores elastic energy in the rubber band 190. This provides tension on the cable 34. When the barbell 24 is raised up, the rubber band 190 provides rotational force to the drum 44*b*, allowing it to respool the cable 34*a*.

DESCRIPTION

FIG. 13

FIG. 13 illustrates another embodiment of my self-spotting device that replaces the recoil spring 48 with a counterweight mechanism. A weight support cable 34*b* is wrapped around a cable drum 44*c*. One end is attached to the barbell 24 (in reference to FIG. 1) and the other is attached to a counterweight 206. The cable 34*b* is secured to the drum 44*c* with a cable clamp 200. The cable clamp can take many forms—the version shown is one of many possibilities. The cable must be of sufficient length to allow the barbell to be lowered completely before the cable 34*b* is unspooled to the position of the cable clamp 200. The cable 34*b* runs through a pulley 204 that positions the counterweight 206 in a convenient position. The pulley 204 turns freely on an axle 202. The pulley 204 and axle 202 are not strictly necessary; they serve only to position the counterweight 206. If there is sufficient space on the workout device upon which the self-spotting unit is mounted (bench press, power rack, cable machine, etc) for the counterweight to hang directly beneath the cable drum 44*c*, the pulley 204 can be eliminated.

OPERATION

The counterweight 206 serves to provide tension on the cable 34*b*. When the ratchet 55 is disengaged and the barbell 24 lowered, the counterweight 206 moves upward. When the barbell 24 is raised up, the counterweight moves down and imparts rotational force on the drum 44*c*. This rotation respools the portion of the cable 34*b* that is in between the barbell 24 and the drum 44*c*. When the ratchet 55 is engaged and the user releases the barbell 24, the ratchet 55 prevents the drum 44*c* from turning. There is then considerably more tension on the barbell side of the cable than the counterweight side. There is, therefore, a natural tendency for the cable 34*b* to slip around the drum 44*c*. The cable clamp 200 prevents this from occuring.

DESCRIPTION

FIG. 14

FIG. 14 illustrates another embodiment of my self-spotting device that uses a cam-locking mechanism instead of a ratchet to lock the weight support cable 34*a*. A cam plate 210 is securely affixed to a case 42*h*. The cam plate 210 can be made of a low-friction material such as hardened steel although other materials may also prove satisfactory. A cam 212 has a pivot hole 216 that is positioned off-center. A pin 214 passes through the hole 216 and is attached to the case 42*h*. The cam has a friction surface 224 that faces the cam plate 210. The base plate 210, cam 212, and pin 214 comprise a cam mechanism 230. The weight support cable 34*a* has one end that is attached to the cable drum 44*d* by the retaining bolts 47. The drum 44*d* contains recoil spring 48 (not shown) and rotates about axle 40*c*. The cable 34*a* passes in between the cam friction surface 224 and the cam plate 210. This embodiment shows the cable being routed through a cable pulley 226, which rotates about a pulley axle 228. This pulley arrangement is not necessary if the drum 44*d* is positioned vertically above the cam mechanism 230. The control cable 56 engages a notch 222 on the long side 218 of the cam 212. There is a coil spring 214 around the control cable 56 that biases the cam mechanism 230 to be engaged.

OPERATION

When the barbell 24 is being lowered, the user disengages the cam mechanism 230 by pulling the control cable 56. As the user lifts the barbell 24 (in reference to FIG. 1) to perform multiple repetitions, he or she continues to pull on the control cable 56. The weight support cable 34*a* freely slides along the cam plate 210 and is spooled in and out by the drum 44*d*. When the user wishes to end his or her set, he or she releases the control cable 56. The coil spring 214 moves the cam 212 toward the base plate 210. The weight support cable 34*a* is still able to freely move toward the drum 44*d* because its movement pushes the friction surface 224 away from the cam plate 210. This prevents the cam mechanism 230 from locking. Once the user stops applying upward force to the barbell 24, the cable 34*a* will move away from the drum 44*d*. The cam 212 is in contact with the cable 34*a* due to the biasing force of coil spring 214. Due to the friction surface 224, the cable 34*a* will pull the cam 212 toward the base-plate 210. This will lock the cable 34*a* in place. The more force there is on the cable 34*a*, the tighter the caroming action will be, preventing the barbell 24 from falling on the user.

ADVANTAGES

From the description above, a number of advantages of some embodiments of my self-spotting device become evident:

(a) The modular design allows the self-spotter to be readily adapted to existing and future exercise equipment designs. This allows it to be offered as an option instead of as a stand-alone product, reducing the financial risk of bringing it to market.

(b) This modularity also means that final assembly of the exercise equipment (bench press, power rack, cable machine, etc) can still be performed by semi-skilled retail store employees or the customers themselves, preventing a substantial increase in shipping costs. The design of the machine described in U.S. Pat. No. 6,379,287 results in it having to be shipped fully assembled. This prevents the manufacturer from reaching a global or even national market.

(c) It is possible to have a self-spotting device that does not require expensive and often unreliable electronic components.

(d) One can incorporate a small motor into the device that would provide for multiple forced repetitions where the user is able to go past the point of failure. Forced repetitions are often desirable in weight training because they impart maximum strain on the user's muscles, stimulating more muscle growth.

(e) One can incorporate a completely mechanical mechanism that would provide one forced repetition per set.

(f) One can incorporate a mechanism that halts downward motion of the barbell if it is dropped, preventing serious injury or death to the user.

(g) It comprises components and materials that are low cost and readily available.

(h) It can be produced at a lower cost than any previous self-spotting devices that provide similar functionality.

Note that a human spotter usually provides only partial support to the lifter on the last few repetitions of a set. These repetitions where the spotter provides just enough upward force to aid the lifter are called forced repetitions. Therefore, there is no need for a motor that can support the entire weight of the barbell in order to provide power assist to the lifter. A motor or a spring-loaded mechanism that can provide upward force at even a fraction of the mass of the free weight is sufficient. Thus, a small motor can be used where forced repetitions are desired because there is no need to hoist the full weight of the barbell. Another option outlined in the detailed description is a powerful spiral torsion spring assist mechanism that is manually preloaded before the lifter begins his set. When the lifter reaches the point of exhaustion, he can actuate the assist mechanism and the spring will provide upward force to the cable.

This self-spotter is compact, modular, and inexpensive. It can be mounted in many places, including on the uprights of a bench press, to the top of a power rack, to the ceiling of a gym, or to the side of an existing exercise machine. It can even be produced in a completely portable version so a weight lifter can take it with him to a fitness center or elsewhere.

CONCLUSION, RAMIFICATIONS, AND SCOPE

Accordingly, the reader will see that my self-spotting device, in its various embodiments, provides all of the functionality of previous devices and mechanisms with the added benefit of modularity and low cost. People who lift weights recreationally will appreciate the low price as well as their new-found ability to achieve effective workouts while training alone. Athletes will enjoy the additional safety when they are lifting extremely heavy weights.

Although the description above contains many specificities, these should not be construed as limiting the scope of the embodiments but merely providing illustrations of some of the presently preferred embodiments. Some examples of different variations:

FIGS. 1, 2A, 2B, 3—The toothed ratchet wheel can be replaced with a toothless ratchet wheel without affecting the form or operation of the self-spotting device. A smooth ratchet wheel would be made of a material that has a high coefficient of friction with a ratchet pawl, such as rubber.

The recoil spring could be located on the outer circumference of the drum in order to provide it with more mechanical advantage.

The case can be eliminated and the components integrally installed into weight lifting equipment.

FIGS. 1 and 3—A pair of dumbbells can replace the barbell.

FIG. 4—The modular self-spotter units can be mounted anywhere that is convenient. One might mount them to a wall, a ceiling, or to a cable machine. One could route the weight support cable through a pulley or a series of pulleys in order to reposition the cable drum and ratchet assembly.

FIG. 9—There could be a clutch mechanism on the motor shaft to disengage the motor from the rotating components of the self-spotter while the user is performing repetitions so that the recoil spring does not have to turn the motor as well as the drum. This would allow for a larger, heavier motor to be used.

FIG. 13—The weight support cable and the counterweight cable can be separate units, each securely affixed at one end to the cable drum.

FIG. 14—The cable drum can be replaced by the counterweight system shown in FIG. 13.

Thus the scope of the embodiments should be determined by the appended claims and their legal equivalents, rather than by the examples given.

I claim:

1. A self spotting apparatus for use in connection with a support structure and a weight assembly, comprising:

an enclosure defining a first and second side walls, where the enclosure is secured to the support structure;

a cable drum;

an axle extending between the first and second side walls to support the cable drum for axial rotation;

a weight support cable having a first end secured to the weight assembly and a second end secured to the cable drum, where the enclosure is supported by the support structure above the weight assembly such that the weight support cable extends substantially vertically between the enclosure and the weight assembly during use of the self spotting apparatus;

a tensioning assembly supported by the enclosure to apply tension to the weight support cable, where the tensioning assembly engages the cable drum to allow the cable to spool off of the cable drum as the weight assembly moves away from the enclosure, and to spool the cable onto the cable drum as the weight assembly moves towards the enclosure;

a brake assembly supported within the enclosure to allow rotation of the cable drum such that cable spools off of the cable drum when in a disengaged configuration, and to engage a portion of the cable drum to prevent cable from spooling off of the cable drum when in an engaged configuration; and a control assembly supported by the weight assembly and operably connected to the brake assembly such that arranging the control assembly in a first position places the brake assembly in the disengaged configuration and arranging the control assembly in a second position places the brake assembly in the engaged configuration.

2. The self spotting apparatus of claim 1 wherein the tensioning assembly comprises a torsion spring acting on the cable drum to cause the cable drum to maintain tension on the weight support cable.

3. The self spotting apparatus of claim 1 wherein the tensioning assembly comprises a counterweight mass connected to a counterweight cable extending from the counterweight mass to the cable drum, where the counterweight mass acts on the cable drum through the counterweight cable to cause the cable drum to maintain tension on the weight support cable.

4. The self spotting apparatus of claim 1 wherein the tensioning assembly comprises a counterweight mass operatively connected to the cable drum such that the counterweight mass moves up when the weight assembly moves down and the counterweight mass moves down when the weight assembly moves up.

5. The self spotting apparatus of claim 1 wherein the tensioning assembly comprises a band of elastic material with one end affixed to the cable drum such that the band stretches when the weight support cable is unspooled from the cable drum.

6. The self spotting apparatus of claim 1 wherein the brake assembly comprises:

a ratchet wheel of a circular shape with a plurality of substantially evenly spaced indentations about its circumference, where the ratchet wheel is mounted to transmit rotational force to the cable drum;

a ratchet pawl with a first end shaped to fit into the indentations and a second end pivotably mounted relative to the cable drum;

a biasing member arranged to bias the brake assembly into the engaged configuration, wherein the control assembly is operatively connected to displace the pawl to move the brake assembly between the engaged and disengaged positions.

7. The self spotting apparatus of claim 1 wherein the brake assembly comprises:

a ratchet wheel of a circular shape with a smooth outer circumference, where the ratchet wheel is mounted to transmit rotational force to the cable drum;

a ratchet pawl having a first end shaped to wedge against the ratchet wheel and a second end pivotably mounted to the cable drum;

a biasing member arranged to bias the brake assembly into the engaged configuration, wherein the control assembly is operatively connected to displace the pawl to move the brake assembly between the engaged and disengaged positions.

8. The self spotting apparatus of claim 1 wherein the brake assembly comprises:

a cam pivotably attached to the cable drum;

a baseplate facing said cam; wherein the weight support cable extends between the cam and the baseplate; and the control means assembly is operatively connected to displace the cam to move the brake assembly between the engaged and disengaged positions.

9. The self spotting apparatus of claim 1 further comprising a centripetal lock that prevents rotation of the cable drum once a pre-set rotational speed is reached.

10. The self spotting apparatus of claim 1 wherein the tensioning assembly comprises:

an electric motor mounted in the enclosure;

and a transfer assembly for transferring rotational force from the motor to the cable drum.

11. The self spotting apparatus of claim 1 wherein the tensioning assembly comprises cable drum:

a second, spring-loaded, rotating member;

a transfer assembly for transferring rotational force from the second, spring-loaded rotating member to the cable drum;

a pre-tensioning member configured to preload the spring-loaded member; wherein the control assembly is arranged to release the tension in the second, spring-loaded member.

12. The self spotting apparatus of claim 1 wherein the tensioning means comprises the cable extending upward from the weight assembly and wrapped around a cylindrical rotating member, further comprising:

a disc-shaped rotating member operatively connected to the cable drum such that rotational motion of the cable drum is transferred to the disc-shaped rotating member;

and a stop assembly for selectively preventing the rotation of the disc-shaped rotating member.

13. A self spotting apparatus for use in connection with a support structure and a weight assembly, comprising:

a weight support cable with one end releasably secured to said weight assembly;

an enclosure adapted to be rigidly connected to the support structure, where the enclosure defines a cable opening, and the enclosure is supported by the support structure above the weight assembly such that the weight support cable extends substantially vertically between the enclosure and the weight assembly during use of the self spotting apparatus;

a first rotating member supported within the enclosure for axial rotation relative to the enclosure, where the weight support cable is wrapped around the first rotating member and is within the enclosure when the weight support cable is wrapped around the first rotating member;

a brake mechanism supported within the enclosure to allow rotation of the first rotating member and thus the extension of the weight support cable from the enclosure when in a disengaged configuration and to engage the first rotating member to prevent the extension of the weight support cable from the enclosure when in an engaged configuration;

a control assembly supported by the weight assembly for allowing the brake mechanism to be placed in the engaged and disengaged configurations;

and a tensioning assembly supported by the enclosure to provide rotational force to the first rotating member to apply tension to the weight support cable when the weight assembly is moving towards the enclosure.

14. The self spotting apparatus of claim 13 wherein the tensioning assembly comprises a spiral torsion spring supported within the enclosure to act on the first rotating member.

15. The self spotting apparatus of claim 13 wherein the tensioning means comprises a counterweight mass, and a counterweight cable operatively connecting the counterweight to the first rotating member such that the counterweight cable is wrapped around the first rotating member in a direction opposite that of the weight support cable.

16. The self spotting apparatus of claim 13 wherein the tensioning assembly comprises a band of elastic material having a first end affixed to the first rotating member and a second end affixed to the enclosure in a manner that causes the elastic to stretch and wrap around the rotating member when the weight support cable is extended from the rotating member.

17. The self spotting apparatus of claim 13 wherein the brake means comprises:

a ratchet wheel of a circular shape with a plurality of substantially evenly spaced indentations about its circumference;

said ratchet wheel mounted so as to transmit rotational force to the rotating member;

a ratchet pawl with one end shaped to fit into the indentations and the other end pivotably mounted to the enclosure;

a biasing member arranged to bias the brake means into the engaged configuration, wherein the control assembly is operatively connected to displace the pawl.

18. The self spotting apparatus of claim 13 wherein the brake means comprises:

a ratchet wheel of a circular shape with a smooth outer circumference, where the ratchet wheel is mounted to transmit rotational force to the first rotating member;

a ratchet pawl with a first end shaped to wedge against the ratchet wheel and a second end pivotably mounted to the enclosure;

a biasing member arranged to bias the brake means into the engaged configuration, wherein the control assembly is operatively connected to displace the pawl.

19. The self spotting apparatus of claim 13 wherein the brake means comprises:

a cam pivotably attached to the support means;

a baseplate positioned facing said cam; wherein the weight support cable extends between the cam and the baseplate; and the control assembly is operatively connected to the cam.

20. The self spotting apparatus of claim 13 further comprising a centripetal lock that prevents rotation of the rotating member once a pre-set rotational speed is reached.

21. The self spotting apparatus of claim 13, further comprising:

an electric motor mounted in the enclosure; and a transfer assembly for transferring rotational force from the motor to the rotating member.

22. The self spotting apparatus of claim 13, further comprising:

a second, spring-loaded, rotating member;

a transfer assembly for transferring rotational force from the second, spring-loaded rotating member to the first rotating member;

a pre-tensioning assembly to preload the second spring-loaded rotating member;

the tension control assembly operatively connected to the second, spring-loaded, rotating member to release the tension in the second, spring-loaded rotating member.

23. The self spotting apparatus of claim 13, further comprising:

a disc-shaped rotating member;

a transfer assembly for transferring rotational motion from the first rotating member to the disc-shaped rotating member;

and a stop assembly for preventing the rotation of the disc-shaped rotating member.

* * * * *